US008162596B1

(12) United States Patent
Kamio

(10) Patent No.: US 8,162,596 B1
(45) Date of Patent: Apr. 24, 2012

(54) SUPPORT DEVICE FOR HIGH PRESSURE PUMPS USABLE IN OR ON THE DECK OF A MARINE VESSEL

(75) Inventor: Keijun Kamio, Sparks, NV (US)

(73) Assignee: EBARA International Corp., Sparks, NV (US)

( * ) Notice: Subject to any disclaimer, the term of this patent is extended or adjusted under 35 U.S.C. 154(b) by 1044 days.

(21) Appl. No.: 12/148,092

(22) Filed: Apr. 15, 2008

Related U.S. Application Data

(60) Provisional application No. 60/925,412, filed on Apr. 20, 2007.

(51) Int. Cl.
*F04D 29/42* (2006.01)

(52) U.S. Cl. ..... 415/119; 415/123; 415/104; 415/131; 415/213.1; 415/229; 417/359

(58) Field of Classification Search ..... 415/119, 415/104, 213.1, 199.1, 123, 229, 1, 131; 417/244, 359, 361
See application file for complete search history.

(56) References Cited

U.S. PATENT DOCUMENTS 1,980,985 A * 11/1934 Deming ..... 418/13
3,635,591 A * 1/1972 Wilkinson ..... 417/410.1
4,313,498 A * 2/1982 Anderson ..... 166/206
7,063,512 B2 6/2006 Haesloop et al.

OTHER PUBLICATIONS

G. Louis Weisser, Modern Submersible Pumps for Cryogenic Liquids, World Pumps #328 Jan. 1994 pp. 23-25.

* cited by examiner

*Primary Examiner* — Ninh H Nguyen
(74) *Attorney, Agent, or Firm* — Edward J. DaRin, Inc.; Edward J. DaRin

(57) ABSTRACT

An improved method and apparatus for supporting and adapting high pressure pumping apparatus for use on or in a marine vessel subject to direct dynamic motions imparted to the marine vessel without damaging the pumping apparatus to thereby extend the useful life of the pumping apparatus. For this purpose the method and apparatus is designed to prevent the deflection of the bearings by providing an axial support and radial damping to vibrations resulting from the motions imparted to the marine vessel. In addition, the pumping shaft is protected when inoperative by preventing the pumping shaft from rotation. Specifically the method and apparatus provide the suction vessel housing the high pressure pumping apparatus to be secured to the marine vessel's deck at all times along with the provision for absorbing the vibrations and stresses due to the marine vessel's movements imparted thereto by being subjected to the direct dynamic motions. The suction vessel for the pumping apparatus is relieved of the stresses at the head plate for the suction vessel by securing the bottom of the pumping apparatus to the suction vessel at all times. The pumping shaft is supported from the bottom of a vertical shaft for axially moving the shaft upwardly to keep the supporting bearing out of deflection so no forces are transmitted to the bearings when the pumping apparatus is non-operational and also prevents the pumping shaft from rotating.

31 Claims, 16 Drawing Sheets

SUPPORT DEVICE FOR HIGH PRESSURE PUMPS USABLE IN OR ON THE DECK OF A MARINE VESSEL

RELATED APPLICATION

Priority is claimed on the basis of Provisional Application bearing Ser. No. 60/925,412, filed on Apr. 20, 2007 and entitled Support for multistage high pressure pump.

FIELD OF INVENTION

The present invention relates to the modification of high pressure pumps designed to be mounted on a fixed or stable base for use on or in marine vessels to prevent damage to the pump's bearings and pump shaft due to the vessel's motions including during both periods of operation of the pump and during periods of non-operation of the pump.

BACKGROUND OF INVENTION

At the present time, land based pumps are usually mounted on a fixed or stable base or on a flexible structure for allowing thermal contraction. When the pumps are so mounted there is little or no movement of the support base during the operation of the pumps. Standard pump securing methods and apparatus for the aforementioned land base usage is not adequate for marine vessel usage without damaging the pump. For marine usage of such a pump mounted on a ship deck or in a ship subjects the pumps to direct dynamic motion such as rolling, pitching, yawning, heaving, surging, swaying all of the time so as to cause damage to the bearings that reduces the useful life of the bearings thereby requiring support devices to be added for supporting the pump, both during periods of operation of the pump and non-operation of the pump. The pump shaft must also be protected against rotation during the intervals the pump is not operational.

An attempt to support a pump for use on the deck of a ship subject to the ship's motions is disclosed in U.S. Pat. No. 7,063,512 entitled Pump Stabilizer and Method granted on Jun. 20, 2006, on an application filed on Jun. 23, 2003. This patent resorts to a pneumatic control system exerting an upward force against a vertical disposed pump shaft during periods of non-operation of the pump for off-loading the bearing normally supporting the pump shaft. This patent further discloses a lateral support fixed to the lower end of the pressure pot housing the pump to prevent the pump housing from swinging laterally within the pressure pot but permitting axial movements. This type of lateral support located at the bottom of the pressure pot appears weak to hold the heavy pump weight (10,000-15,000 pounds) during lateral motion. The pneumatic control system disclosed in the U.S. Pat. No. 7,063,512 is difficult to adjust and requires an additional control unit to maintain the desired operative pressure. It also appears that the disclosed sealing of the piston of the pneumatic system may cause leaks after a period of time resulting in the need for frequent maintenance. It also appears that the installation of the pump after maintenance is a hard job that further requires expert hard installation work, as well. The patent disclosure includes an extension of the pump shaft at the top end of the vertical shaft for the manual control of the pump shaft and appears to be a back-up of the disclosed pneumatic control apparatus. The shaft extension mounts a nut for manual movement of the shaft to relieve the support bearings of stress during periods of non-use of the pump and which stress is produced due to the movements of the marine vessel. The adjustable nut must be removed, completely, during periods of operation of the pump. This manual operation structure provides additional leakage points exposed to the atmosphere. This system requires use of many sealing devices. Initially, the adjustment of the relative positions of the shaft and piston is required to be done at both normal or ambient temperatures and cold temperatures. Other practical problems appear inherently in the use of the prior art pneumatic system.

BRIEF SUMMARY OF INVENTION

The present invention is directed to an improved mechanical method and apparatus for supporting and adapting high pressure pumping apparatus for use on or in a marine vessel subject to a direct dynamic motion imparted to a marine vessel. The direct dynamic motion comprises rolling, pitching, yawing, heaving, surging, swaying, all of the time, including both during the periods of the pumping operation and periods of non-operating of the pump so the improved methods and apparatus functions without damage to the pumping apparatus. The damage to pumping apparatus not adapted for use on a marine vessel subject to direct dynamic motion may cause the support bearings to deflect if no axial support is provided and vibrations due to the rocking of the marine vessel may wear the bearings if no radial damping is provided. It is also necessary to keep the pumping shaft from rotating when it is not operating so as to protect the bearings and rotor thereof. It is important to understand that when the pumping apparatus is mounted to the upper deck of a marine vessel the severity of the direct dynamic motions is greater than a location below the upper deck and extra support for the protective means is required to prevent damage to the pumping apparatus when mounted on the deck of a vessel.

In accordance with the teachings of the present invention the support devices for the high pressure pump include the following:

(1) The suction vessel is provided with means for securing the vessel to the marine vessel's deck at all times. The preferred means includes a provision for absorbing vibrations and stresses due to the marine vessel's movements.

(2) The pumping apparatus is provided with means for securing the bottom of the pumping apparatus to the suction vessels at all times to relieve the stress at the head plate during the marine vessel's movements.

(3) The pump shaft is provided with a support from the bottom of a vertically oriented shaft by either a mechanical means or pressure actuated means for moving the shaft axially, upwardly to keep the shaft supporting bearings out of deflection and the shaft from rotating when the pumping apparatus is not operational. The bearings are kept out of deflection by providing the pump shaft comprising the combination of a catch disc means and a seat coacting when they are engaged to prevent the rotation of the pump shaft. In this combination the weight of the pumping apparatus prevents the upward axial travel of the shaft and the catch disc means prevents the downward axial travel of the shaft and supports the pumping apparatus so that there are no forces transmitted to the bearings when the pumping apparatus is non-operational and also prevents rotations of the pump shaft. During operation of the pumping apparatus the resulting pressure differential causes the shaft to move axially upwardly to cause the disengagement of the catch disc means and its cooperating seat supporting the pump shaft and thereby allowing the desired pumping operations.

The pressure actuated embodiments cause the shaft to be moved by manual manipulation or automatic pressure actuated means for positioning the shaft for pumping action and engages and supports the shaft for non-pumping action.

Among the modifications of the basic concepts disclosed herein is self-locking embodiments having guide tracks secured to the shaft functioning with balls that engage the shaft to prevent any spinning action and responsive to the rotating shaft for generating forces to maintain the balls out of a locking position with the shaft permitting fluid pumping apparatus to operate normally. Other similar braking configurations taking advantage of the forces generated by the rotating shaft are disclosed.

BRIEF DESCRIPTION OF THE SEVERAL VIEWS OF THE DRAWINGS

These and other features of the present invention maybe more fully appreciated when considered in the light of the following specification and drawings in which.

DETAILED DESCRIPTION OF THE INVENTION

Figure 1:
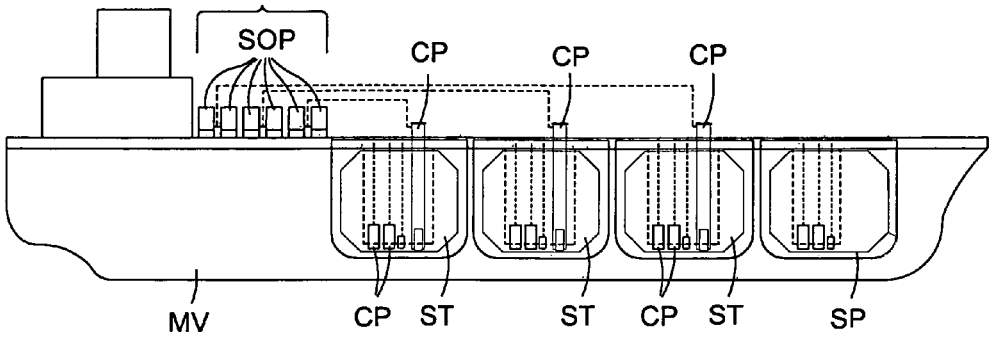
FIG. 1 is diagrammatic view of the present day typical marine vessel and tank configuration for transporting liquefied natural gas.

Now referring to the drawings the basic concepts of the invention utilized for the implementation of the various embodiments will be described in detail. With reference to FIG. 1, the type of marine vessel or tanker configuration presently employed for loading, transporting and discharging the liquefied natural gas, LNG, will be examined. The marine vessel MV is illustrated with a cargo containment system in the lower deck illustrated with a multiplicity of LNG storage tanks ST for storing the LNG during transport. The tanks ST are each provided with individual cargo pumps CP for pumping the stored LNG to the upper deck to the high pressure pumping apparatus or the "send out pumps", SOP, on the upper deck of the vessel MV for conveying the stored LNG through the high pressure pumping apparatus, SOP, for discharging the LNG in a stream from the marine vessel MV to the point of usage of the LNG transportation and discharging the liquefied natural gas and a regasification system for discharging the natural gas, NG, for the marine vessel MV.

Figure 2:
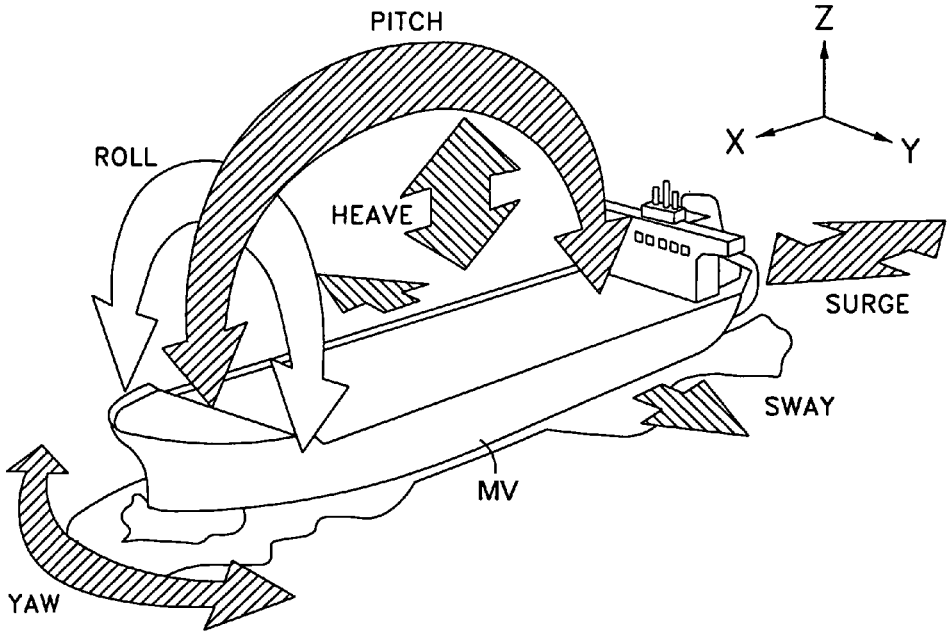
FIG. 2 is a diagrammatic view of a typical marine vessel showing the vessels motions in six degrees of freedom in the x, y, and z axes.

The marine vessel MV transporting the LNG cargo is subject to the direct dynamic motions and acceleration forces imparted to the marine vessel in traversing the open seas. These dynamic motions are diagrammatically illustrated in FIG. 2 and comprise a rolling motion from the 6 degrees of freedom that occur all of the time the vessel is traveling on the seas. The acceleration forces are produced by the rolling motions, pitching motions and the yawing motion as angular acceleration on the order of 3.0-15 degrees per S. The resulting vessel movements are imparted to the mechanical equipment namely the pumping apparatus aboard the vessel MV and can cause damage thereto including the LNG high pressure pumps, SOP. In contemplating FIG. 1 wherein the high pressure send out pumps. SOP, are mounted on the upper deck, the resulting movements are greater than the same movements below the vessel deck so that damage to the pump bearings, pump shafts, and drive motor rotors are more readily damaged thereto due to their elevated sites. This requires additional protection. Since the pumping apparatus presently utilized on marine vessels for transporting the liquefied natural gas are pumps designed to be mounted on stable base they require some protective device to be provided to extend the useful life of the pumping apparatus for marine usage and for minimizing the damaging effects of the direct dynamic motions on the vessel MV.

Figure 3:
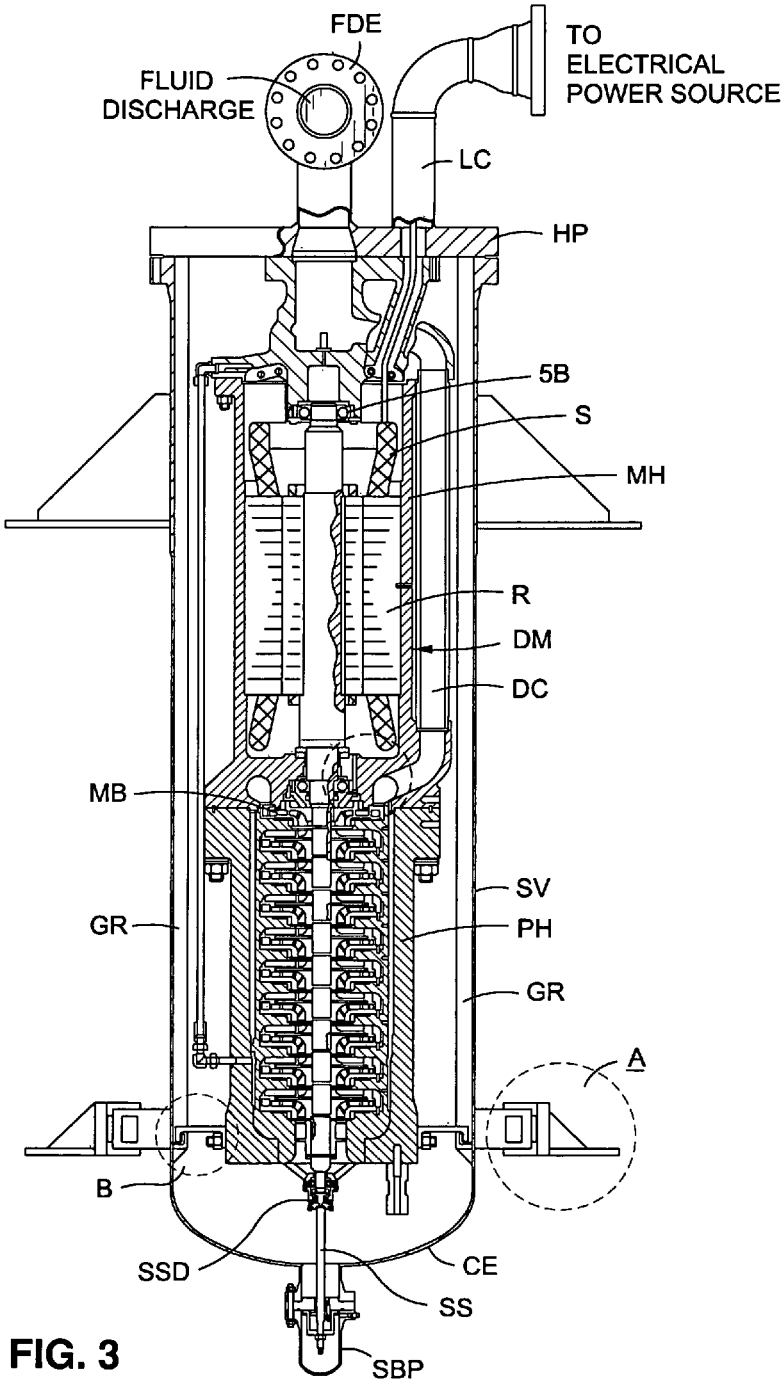
FIG. 3 is a cross-sectional view of a multi-stage high pressure pumping apparatus mounted in a suction vessel and capable of functioning as send out pumps mountable on the upper deck of a marine vessel of the type illustrated in FIG. 1 and illustrating the vessel support bracket securable to the marine vessel deck on the bottom right and the pump support bracket on the bottom left sides of the marine vessel as illustrated in FIG. 3.

With these problems in mind a typical multi-stage high pressure pumping apparatus as illustrated in FIG. 3 will be examined. Due to the aforementioned dynamic motions the protective devices must provide:

1. An axial support to keep the main bearings of the pumping apparatus out of deflection due to major shifts of the marine vessel due to the rocketing motion of the marine transport vessel MV.
2. Radial damping is necessary to prevent vibrations from wearing the bearings due to the vessel's rocking.
3. The pumping shaft has to be locked up to keep it from spinning during the intervals the pumping apparatus is not operative for the protection of the pump bearings and pump drive motor rotors.

Now referring specifically to FIG. 3, a typical high pressure array of multistage, centrifugal pumps are illustrated mounted on a single shaft with the pump drive motor on the single shaft and the combination mounted in a suction vessel SV having a head plate HP adjacent the pump drive motor end and a closed end CE at the opposite end. The array of multistage, centrifugal pumps are mounted in an individual housing PH on the single shaft SS and the drive motor DM is mounted in the motor housing MH, in serial relationship with the pumping housing PH on the shaft SS. The drive motor DM comprise a rotor R, and a stator S within the housing MH with the upper end or the top end of the shaft SS mounted to the upper shaft support bearing SB. The stator windings SW are connected to a power cable arranged in a conduit that extends through the head plate HP and by the external L-shaped conduit LC coupled to a suitable electrical power source for energizing the stator winding for motor action. The bottom end of the shaft SS is mounted to the shaft supporting device SSD that will be described in detail hereinafter. The fluid discharge from the multistage, high pressure pumps are provided with a discharge conduit DC arranged within the suction vessel SV adjacent the drive motor housing MH illustrated on the right hand side of the housing in FIG. 3 for receiving the pumped fluid discharged from the final or top most pumping stage and coupled directly (not shown) to the external fluid discharge coupling element FDE. The drive motor housing MH and the multistage pumping device housing PH are linearly aligned and secured within the suction vessel SV. Immediately beyond the final pumping stage a thrust equalizing mechanism TEM is mounted for offsetting the thrust forces generated by the pumping stages as is well known. The thrust equalizing mechanism disclosed in the publication World Pumps, No. 328 published in January 1994 by G. L. Weisser in an article entitled "Modern Submersible Pumps for Cryogenic Liquids" on page 23-25. The Weisser publication is incorporated herein by reference. The above described arrangement includes guide rails GR within the suction vessel SV for slidably moving the multistage pumping apparatus in and out of the suction vessel SV so that it is always in the correct position. The arrangement illustrated in FIG. 3 can be considered a typical, multistage, high pressure send out pump configuration and six send out pumps, SOP, are illustrated in FIG. 1 in accordance with the teachings of the present invention.

Figure 5:
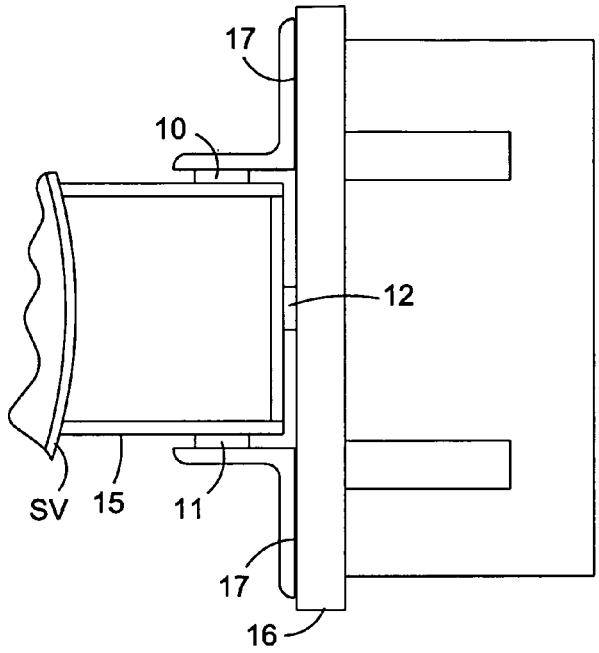
FIG. 5 is a top view of the vessel support bracket taken along the line 5-5 of FIG. 4.
Figure 4:
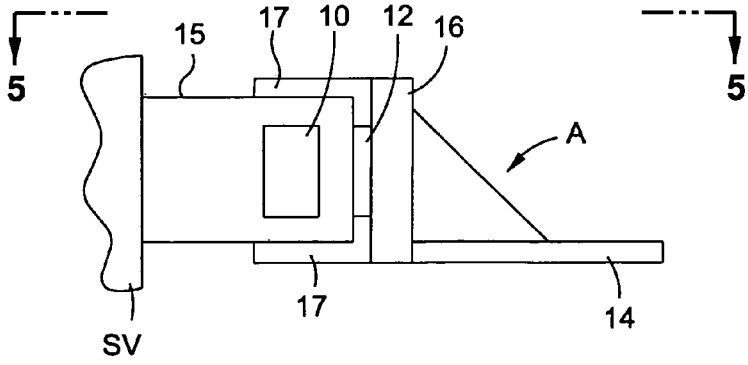
FIG. 4 is an enlarged side view of the vessel support bracket of FIG. 3.

The initial protective device provided by the present invention is the means for securing the suction vessel SV to the deck of the marine vessel MV at all times and is illustrated in FIG. 3 at the lower, right hand side of the vessel SV within the dotted line circle identified as the "A" protective device. The details of protective device "A" are illustrated in FIGS. 4 and 5. The vessel support bracket A comprises a U-shaped stainless steel bracket 15 having three resilient pads for absorbing the vibrations and stresses resulting from the vessel MV movements. A material that is suitable for the resilient pads is a commercially available plastic identified as "TEFLON" a registered Trademark as noted on page A-4 of THE Manual of Patent Examination Practice, wherein it is MPEP, defined as a synthetic resinous fluorine containing polymer in various forms. Any soft, resilient material equivalent to the "TEFLON" material is also suitable. In the views of the vessel support bracket "A" the resilient pads are identified as the "TEFLON" pads 10, 11, and 12 with the bracket being constructed of stainless steel. The horizontal arms of the U-shaped vessel support bracket 15 are both secured to the suction vessel SV. The vessel support bracket 15 is used with support 16 having two spaced arms 14 secured to the marine vessel MV. (not shown) The opposite side of the support 16 from the securement arms 14 are a pair of spaced L-shaped brackets 17 secured to the support 16 and spaced apart a distance for accommodating the vessel support bracket 15 or the vertical portion of the bracket 15 spaced from the support 16 by the resilient pad 16 and the horizontal arms of the bracket 15 being each spaced from the bracket 17 by the resilient pads 10 and 11 as best viewed in FIG. 5. It should now be evident that the provision of the three resilient pads 10, 11, and 12 results in isolating the suction vessel SV from the movements and vibrations of the marine vessel MV.

Figure 6:
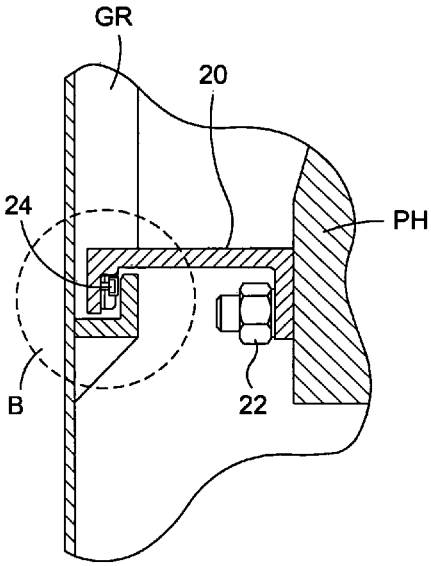
FIG. 6 is a partial cross-sectional view of the pump support bracket of FIG. 3 showing securement of the bottom end of the pump to the suction vessel.
Figure 7:
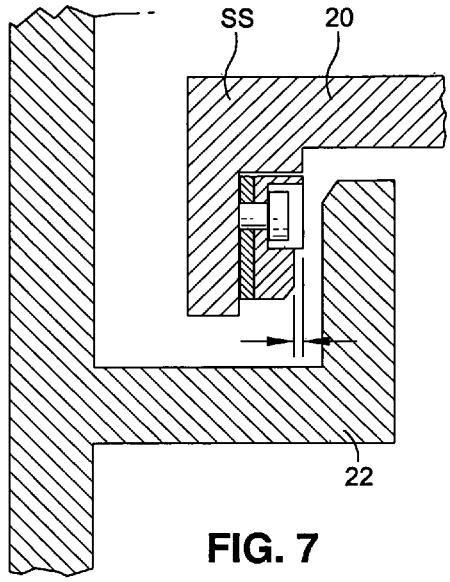
FIG. 7 is enlarged view of the secured pump support bracket of FIG. 6 and illustrating the clearance between guide rail bracket and resilient pad carried by the support bracket.
Figure 8:
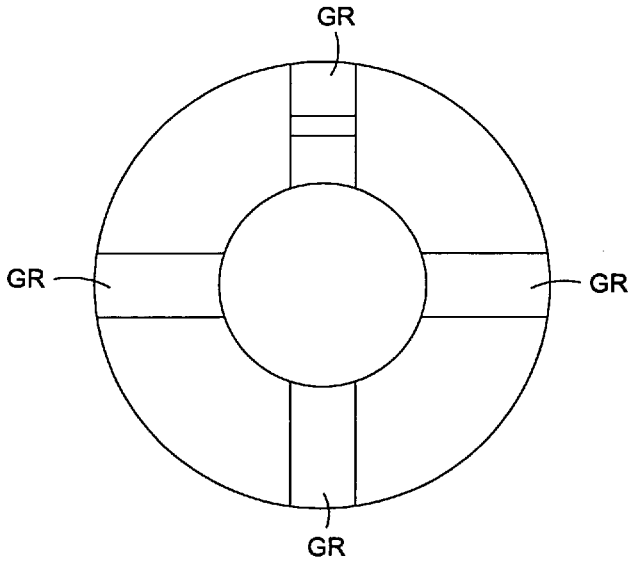
FIG. 8 is a diagrammatic view of the inside of the suction vessel of FIG. 3 and the four guide rails for the installing the pump in the vessel by means of the guide rails and removable of the pump from the vessel by the guide rails.

The next protective device is to secure the bottom end of the pumping apparatus to the deck of the marine vessel MV at all times for relieving the stress at the head plate HP during the above described motions imparted to the marine vessel. This pump support bracket is illustrated in FIG. 3 at the bottom left hand side of the pumping apparatus, highlighted by the dotted lines forming a circle around the pump support brackets identified as protective device "B". The details of device "B" are illustrated in FIGS. 6 and 7 along with the details of the guide rails GR on the inside wall of the suction vessel SV illustrated in FIG. 8.

The guide rails GR are constructed of stainless steel and mounted at 90 degree intervals around the inside wall of the vessel SV. By the use of these guide rails GR the pumping apparatus may not only be readily withdrawn from the vessel V but upon re-installation by sliding it along the rails GR for lowering it into vessel SV it will always be mounted in the same position. For the purposes of securing the pumping apparatus a securing bracket, illustrated in the form of a shallow, inverted U 20 is secured by means of a fastener 22 to the pumping apparatus housing PH as illustrated in FIG. 6. This bracket 20 is constructed of stainless steel. The wall of the housing PH is constructed of aluminum. The bracket 20 is designed to engage a L-shaped bracket 22 mounted to the inside wall of vessel SV at the bottom of each guide rail GR. The bracket 22 is constructed of stainless steel. The bracket 20 mounts a resilient pad 24 at its left hand end, as illustrated in FIG. 6, so as to be interposed between the inter-engaged vertical ends of brackets 20 and 22. The arrangement of the brackets 20 and 22 and resilient pad 24 is defined with a pre-selected clearance between the inter-engaged ends of the brackets 20 and 22 on the order of 0.005 inches and which clearance is measured after fabrication with shims and the appropriate shim positioned in the gap. The resilient pad 24 may be constructed of the aforementioned "TEFLON" material. It will be recognized by those within the skill in the art that the materials used all possess different coefficients of expansion. The design is such that when the pumping apparatus is operating, the aluminum pumping housing PH will contract more than the stainless steel parts or the brackets 20 and 22 and will result in strengthening the securement of the pumping apparatus and the shrinkage will be accommodated by the resilient pad 24, preferable of the "TEFLON" construction. When the pumping apparatus is not operating, the aluminum housing PH and the stainless steel brackets 20 and 22 will return to their original dimensions and the "TEFLON" pad 24 will expand but the brackets 20 and 22 will still be inter-engaged, as desired. It should now be appreciated that method of securing the pumping apparatus secures the bottom end of the pumping apparatus at all times and thereby relieves the stress on the head plate HP during the movements imparted to the marine vessel MV.

It should now be appreciated that the bracket 20 secured to the pumping housing PH is carried when the pumping apparatus is moved into and out of the suction vessel SV and fixes the position of the pumping apparatus in the vessel. When the pumping apparatus is being lowered into the vessel SV, it is slid along the guide rails GR until it engages the vessel support brackets 22 that is secured to the wall of the vessel SV at the end of each of the guide rail GR and the two brackets are engaged; see FIG. 6. The shim positioned in the gap maintains the engagement of the two brackets 20 and 22. These two brackets also protect the pumping apparatus from swinging within the suction vessel SV during the marine vessel's motions.

Figure 9:
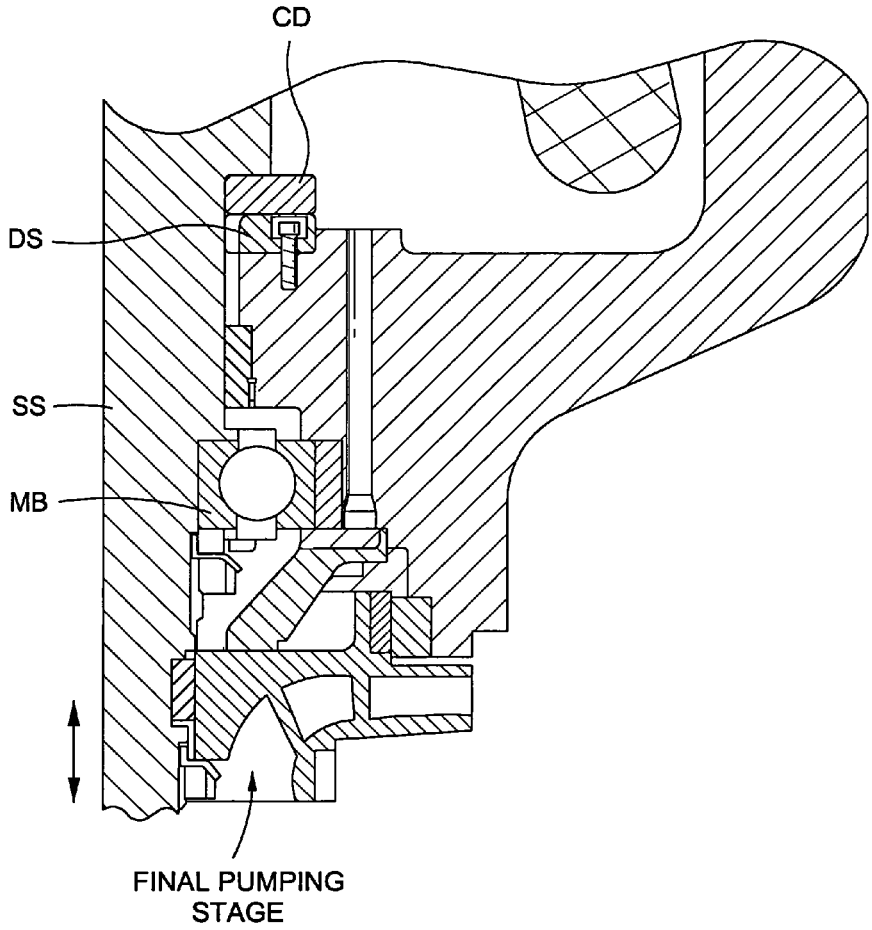
FIG. 9 is a partial, cross-sectional view of the pump shaft having a shaft catch disc mounted thereon and in engagement with the seat for keeping the pump bearings out of deflection and the pump shaft from rotating when the pump is not in operation.

Now referring to FIG. 9, the improved method and apparatus for maintaining the bearings of the pumping apparatus out of deflection and the pump shaft from spinning when the pumping apparatus is non-operational will be described. For this purpose, a shaft catch disc CD is provided to be mounted to the pump shaft SS after the final pumping stage or the final impeller and the thrust equalizing device TEM immediately before the pump drive motor, as illustrated in FIG. 9. The catch disc CD is illustrated mounted to the pump shaft SS and is constructed and designed to mount to the entire circumference of the shaft SS and preferably constructed of a ceramic material. The disc CD coacts with the disc seat DS and the two are shown as in contact with one another, that is their at rest position for preventing the shaft SS from rotating. The seat DS is mounted above the main bearing MB and may be constructed of a ceramic material or the "TEFLON" material the full circumference of the shaft SS. The design of the catch disc CD takes advantage of the weight of the apparatus for operability. To this end the physical size of the apparatus has a overall height of 178-188 inches and a width of 4 feet. The weight may run from 13,500 to 17,500 pounds or 6125 KG to 7936 KG, the weight of the pumping apparatus and fuction keeps the catch disc CD and seat DS in contact or seated when the pumping shaft SS is not operational and thereby prevents the shaft from spinning or rotating. The weight of the pumping apparatus also prevents the upward axial travel of the shaft SS and the catch disc CD prevents the downward axial travel of the shaft thereby maintaining them in the illustrated position of FIG. 9. When the pumping apparatus is operational and the shaft SS is rotating, the shaft SS moves axially upward along with the catch disc CD so that it disengages from the seat DS thereby permitting the normal operation of the pumping apparatus. When the fluid pumping stops, the shaft SS moves axially downwardly to it resting position in engagement with the disc seat DS.

The preferable arrangement of the catch disc CD and seat DS takes into consideration the axial shifts in the shaft SS to provide the desired protection of the bearings. For this purpose, it is preferable that a small gap be defined between the disc CD and seat DS that is smaller than the downward shift of the shaft SS so the bearing never goes into downward deflection but the shaft rests on the catch disc CD, as desired. At this rest position, it should be noted that there are no forces on the bearing while the catch disc CD supports the pumping apparatus to provide the desired protection of the bearings and thereby the extended life for the pumping apparatus. The bearings never go into downward deflection as long as the catch disc CD is supporting the pumping apparatus.

Figure 10:
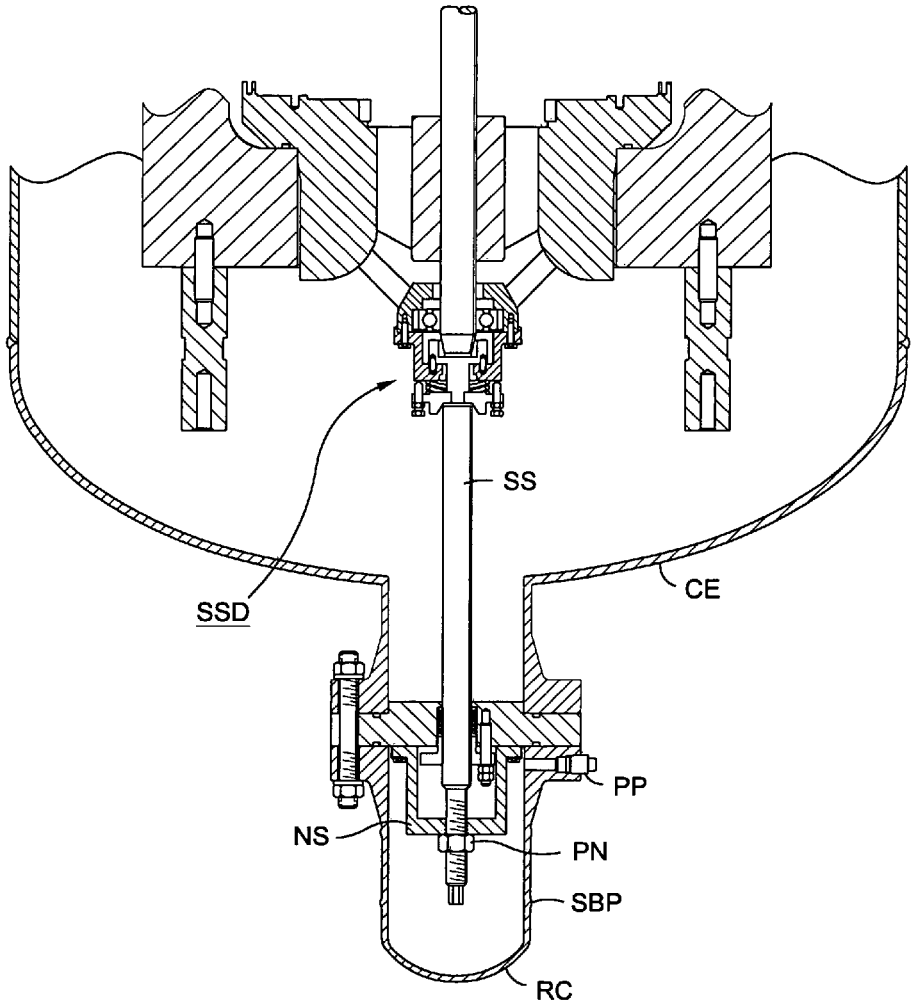
FIG. 10 is a partial cross-sectional view of the bottom end of the suction vessel illustrating the arrangement of the shaft supporting device in the suction vessel and manual structure for adjusting the shaft position in the stuffing box, penetration with purge protector.

Now referring to FIG. 10, a further shaft support device for maintaining the bearings out of deflection and the pump shaft from rotating when the fluid pumping is not operational will be examined. The illustration in FIG. 10 is the bottom end of the suction vessel SV as illustrated in FIG. 3, with the shaft support device SSD that is externally actuated and used in conjunction with the stuffing box penetration with purge cover mounted over the shaft SS and arranged outside the bottom CE of the vessel SV and further identified as the element SBP.

Figure 12:
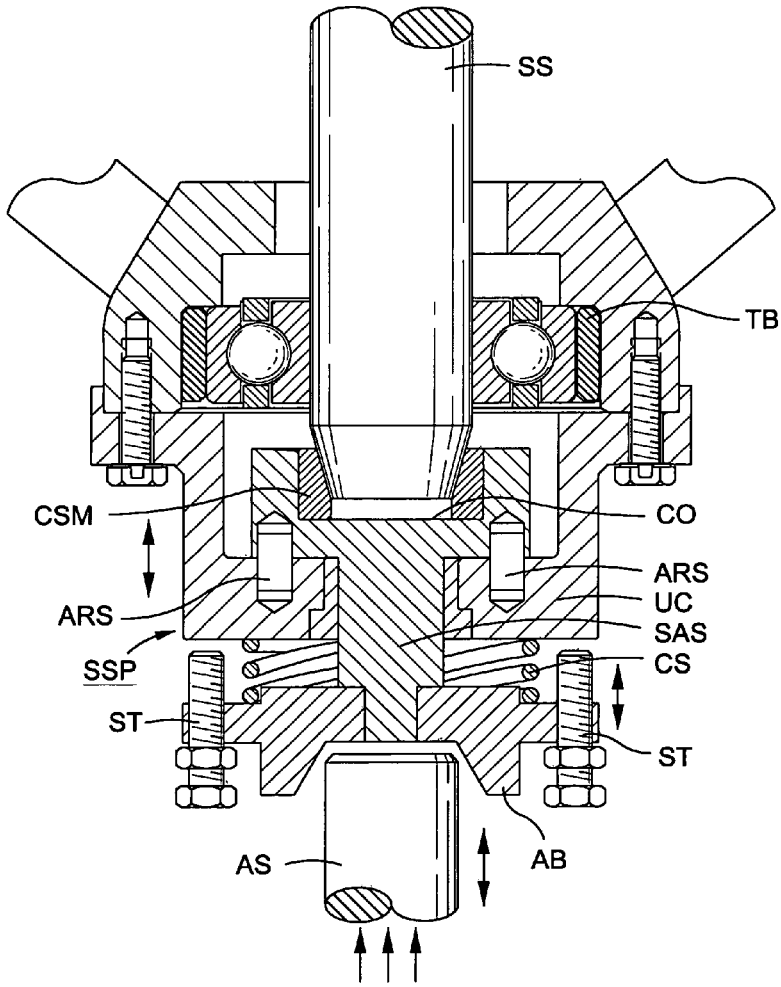
FIG. 12 is a partial, enlarged, cross-sectional view of the shaft support device portion of FIG. 10 actuable externally and illustrating further means to prevent rotation of the pump shaft.

The shaft support device SSD will first be examined and described from the enlarged view of the support device SSD illustrated in FIG. 12. The shaft support device SSD is externally actuated (not shown), by the actuation of shaft AS that is caused to move vertically into engagement with the spring actuated shaft support system SSD. The pumping apparatus shaft SS is illustrated in FIG. 12 in the position that allows rotation of the shaft SS and is disengaged from the shaft AS. The lower end of the shaft SS is supported by the tail bearing TB and the shaft extends beyond the bearing. The tail end of the shaft SS is tapered and the tapered end is provided with a cone shaped, soft resilient material CSM such as "TEFLON" or the like, in turn supported by a support defined for engaging the shaft SS by means of the cone shaped material CSM. As illustrated in FIG. 12. the support SAS has a central opening CO wherein the cone shaped material CSM resides and in the illustrated position the bottom end of the shaft SS is spaced from the bottom of the central opening CO. The support SAS is mounted at its top end to a U-shaped carrier UC that is secured to the pump housing by fasteners as illustrated. The carrier UC is provided with a pair of anti-rotation pins ARS mounted between the carrier UC and the support SAS on opposite sides of the pump shaft SS for further assurance that both the shaft SS and the shaft support system SSD do not rotate when the pumping apparatus is idle. The support SAS and the carrier UC are engaged with a coil spring CS on the top side of an actuating body AB on the bottom side of the spring CS and also secures the tail end of the support, SAS centrally of the body AB. The top side of the spring CS is illustrated in engagement with the bottom side of the carrier UC and is spaced around the support SAS. The pump shaft SS is elevated to prevent the deflection of the bearings when the pumping apparatus is idle. For this purpose, the actuating force is applied to the shaft AS to cause it to compress the coil spring CS which moves the support SAS into engagement with the tail end of the shaft and supports the shaft SS in the desired elevated position protecting the system's bearings. The actuating body AB is provided with a pair of stops ST at each end to limit the upward travel of the body. The stops ST are illustrated in the form of a threaded fastener having a nut secured to the shank of the fastener at a position for limiting the upward travel of the body AB which is normally spaced from the bottom side of the carrier UC. When the pumping apparatus becomes operative, the actuating force is removed from the shaft AS and the spring CS relaxes to permit the shaft support system SSD to move downwardly out of contact with shaft SS to its at rest position for allowing the shaft SS to rotate.

Figure 11:
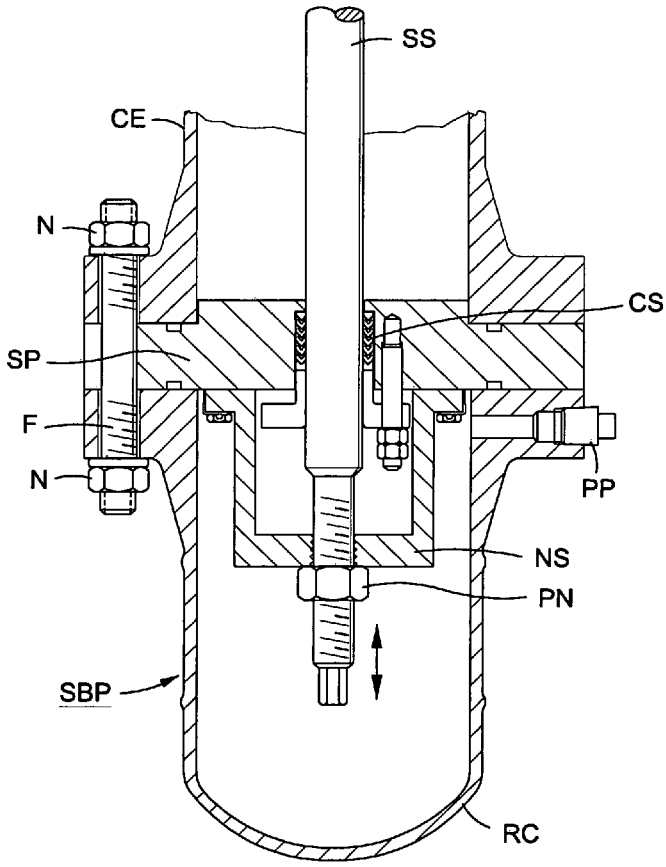
FIG. 11 is an enlarged view of the shaft stuffing box and supporting structure portion illustrated in FIG. 10 for the manual actuation of the shaft position accessible by the removable cover.

The examination of the stuffing box penetration with purge protector PP is best viewed and described by the enlarged view of FIG. 11. As it will be evident from FIG. 10 the stuffing box enclosure is a removable cover RC which is secured to central opening of the tail end CE of the suction vessel SV, see FIG. 11. The suction vessel SV proper is isolated from the structure within the cover RC by means of a partition SP horizontally positioned across the open end of the cover RC and centrally apertured to accommodate the shaft SS extending into the cover RC. The central aperture for the partition SP is provided with a Chevron seal CS mounted within the aperture to seal off the tail end of shaft SS and secured thereto by a fastener as illustrated in FIG. 11. The purge protector PP is mounted to the cover RC immediately below the partition SP and communicates with the interior of the cover. The shaft SS extends into the interior of the cover RC and is accessible to permit the shaft to be manually position the shaft SS and in turn for the shaft support device SSD when utilized in combination. The U-shaped cover RC is secured on one side by means of a fastener F secured between the end CE of the vessel SV and the left hand side of the cover RC as best viewed in FIG. 11. The fastener F is a threaded shank having a securing nut N at both ends of the fastener. The tail end of the shaft SS is of a reduced diameter from the shaft proper and threaded. A portion of the tail end of the shaft SS is mounted within a U-shaped enclosure NS secured to the partition SP by suitable fasteners. The enclosure NS is centrally apertured to permit the threaded portion of the shaft to extend beyond the enclosure NS and to be rotatable therein. The manual control of the shaft SS is produced by means of positioning nut PN threaded against the bottom side of the enclosure NS functioning as a stop to prevent overstressing of the bearing for the positioning of the shaft SS at the support device SSD. The shaft SS is moved vertically, up or down, by manually rotating the end of the shaft, when it is exposed by the removal of the cover RC. The entire shaft SS rotates in response to the manual rotation of the shaft SS at the support device SSD. The shaft SS can be moved when it is rotated about 0.25 inches. Once manually positioned, the cover RC can be secured in place for use.

Figure 13:
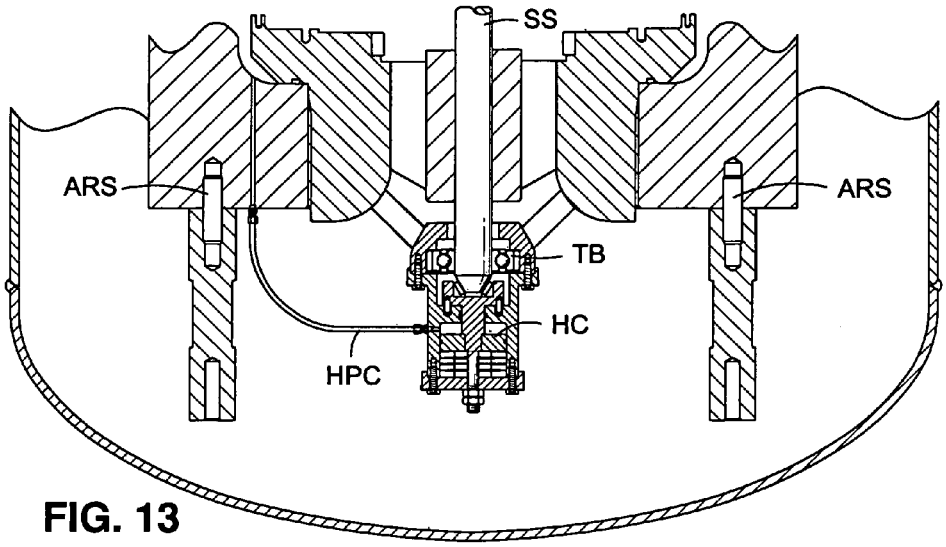
FIG. 13 is an automatic high pressure embodiment of the shaft supporting device as illustrated in FIG. 10 without the stuffing box structure, and illustrated in a disengaged position with the pump shaft for permitting the shaft to rotate.
Figure 14:
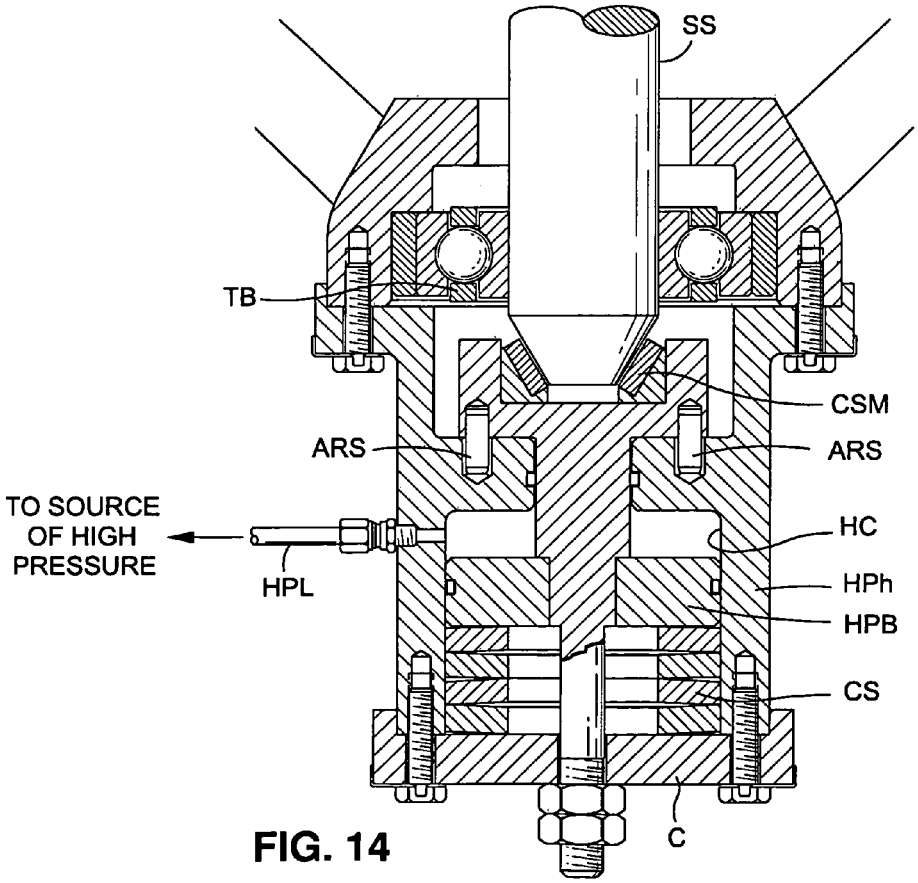
FIG. 14 is an enlarged view of the high pressure embodiment of FIG. 13 for maintaining the bearings out of deflection and the pump shaft from rotating when in non-operational mode and including further means to prevent rotation of the pump shaft.

Now referring to FIGS. 13 and 14 the high pressure embodiment of the shaft supporting device of FIG. 10 will be described for maintaining the bearings out of deflection and the pump shaft from rotating. This embodiment eliminates the use of the stuffing box of FIG. 10 but relies on the use of a high pressure for operability. The top portion of the shaft support device of FIGS. 13 and 14 is generally the same as described for FIG. 12 namely the enclosure of the tail end of the shaft SS by the same cone shaped TEFLON material and associated structure. In this embodiment a high pressure chamber HC is defined intermediate the housing HPh defined immediately below the mount for the anti-rotation pins ARS by means of the barrier HPh sealed to the lower central opening for the housing HPh as evident from FIG. 14. The bottom end of the central aperture for the housing HPh an actuating spring CS is mounted and secured to the housing by a cap C secured to the bottom end of housing HPh, as illustrated. The spring CS may be in the form of disc or coil spring. In this embodiment, when the pumping apparatus is operating, a high pressure stream is applied is to the to the high pressure line HP communicating with the chamber HC to cause the compression of the spring CS and thereby causing the shaft support system to move downwardly and release the shaft SS. During the idle moments the high pressure is removed from the chamber HC, the spring CS expands to cause the support system SSD to move upwardly and elevates the shaft SS to the position illustrated in FIG. 14. In this position, the bearings are out deflection and the pumping shaft SS will not rotate or spin during the non-operational periods of the fluid pumping apparatus.

Figure 15:
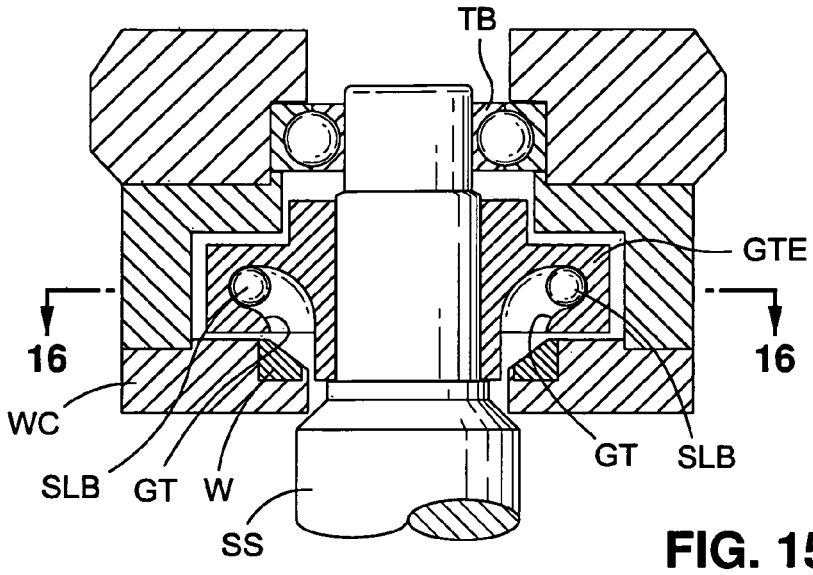
FIG. 15 is a partial, cross-sectional view of the pump shaft and illustrates a ball of self-locking embodiment of the invention for preventing the pump shaft from rotating during non-operative intervals of the pumping apparatus as illustrated below the upper bearing of the pump shaft and illustrated in the unlocked shaft position permitting normal pump operation.

Now referring to FIGS. 15-17 the illustrated self-locking arrangement for preventing the pumping apparatus shaft SS from rotating will be described. The self-locking structure is positioned immediately below the tail bearing TB for the shaft SS and comprises a plurality of guide tracks GT attached to the shaft SS to be rotatable in unison, four tracks GT are illustrated in the drawings and are evenly spaced around the shaft SS as best viewed in FIG. 16. The guide tracks are defined within the element GTE that is secured to the shaft SS. The four guide tracks GT include 4 balls, one per guide track, that move in the individual guide tracks. The tracks GT are sloped downwardly towards the shaft SS in an arcuate configuration as seen in FIG. 15. The balls SLB are configured to ride along the arcuate tracks in accordance with the operations of the shaft. The open end of the tracks GT is restricted by a wedge W mounted to a carrier WC for trapping the balls SLB against the shaft between the wedge W and the open ends of the tracks GT as illustrated in FIG. 17. The wedge W may be constructed of a braking material for trapping the balls to cause the lock up of the shaft SS. The braking material may be constructed of "TEFLON" or a ceramic friction material. When the fluid pumping apparatus is operational, the shaft SS is rotating, friction and centrifugal forces are generated that cause the balls SLB to move up their arcuate tracks GT away from the shaft SS allowing the shaft to function normally. When the shaft SS is non-operative, the balls SLB move downwardly toward the shaft in the tracks GT and lock in place in the tracks for locking the balls in a shaft locking position, as best illustrated in FIG. 17.

Figure 16:
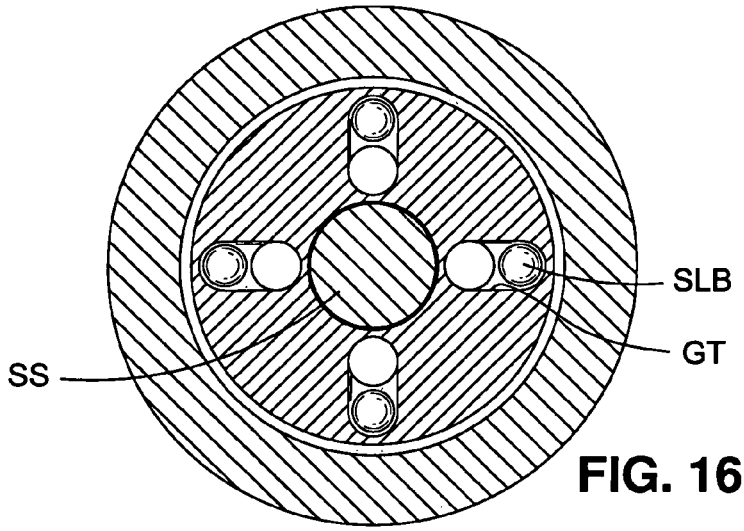
FIG. 16 is a cross-sectional view of the ball self-locking embodiment taken along the line 16-16 of FIG. 15.
Figure 17:
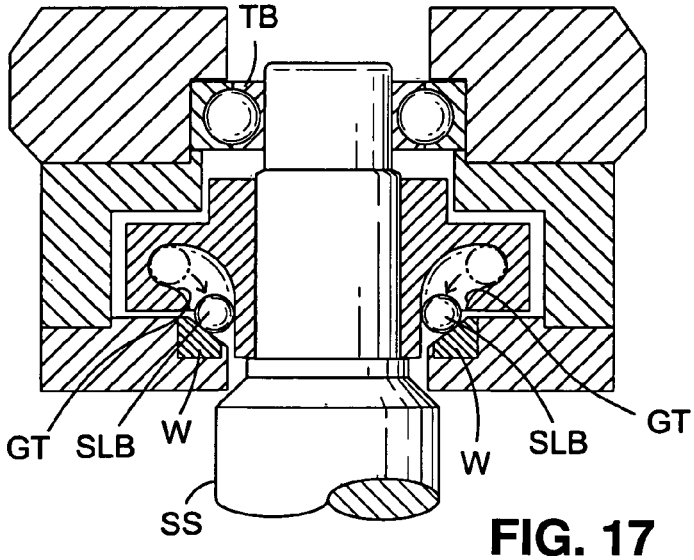
FIG. 17 is a partial, cross-sectional view of the pump shaft, ball self-locking embodiment of FIG. 15 and illustrating the shaft locking position of the balls during the non-operative intervals of the pumping apparatus.
Figure 18:
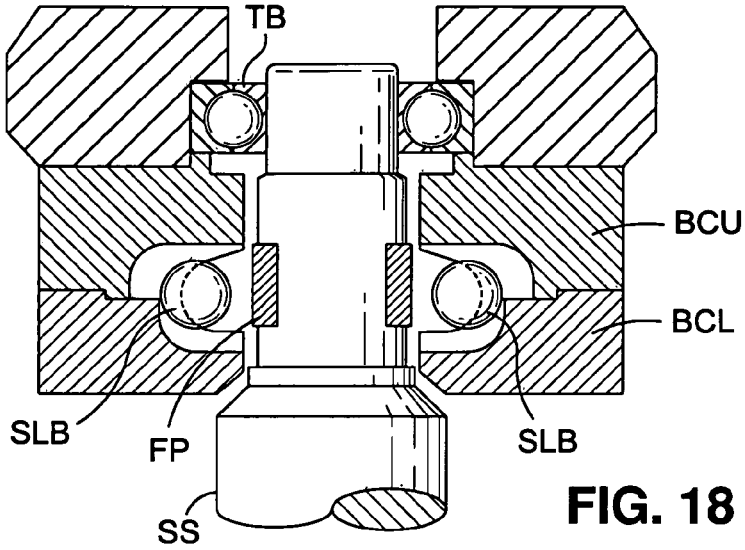
FIG. 18 is a partial, cross-sectional view of the pump shaft, illustrating another embodiment of a ball, self-locking device for keeping the pump shaft from rotating and illustrating the unlocked shaft for permitting normal pump operation.
Figure 20:
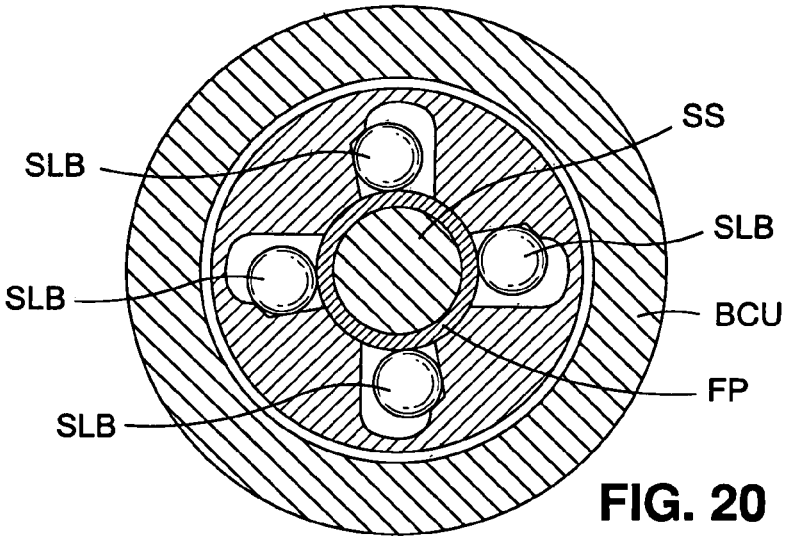
FIG. 20 is a cross-sectional view taken along the line 20-20 of FIG. 19.
Figure 19:
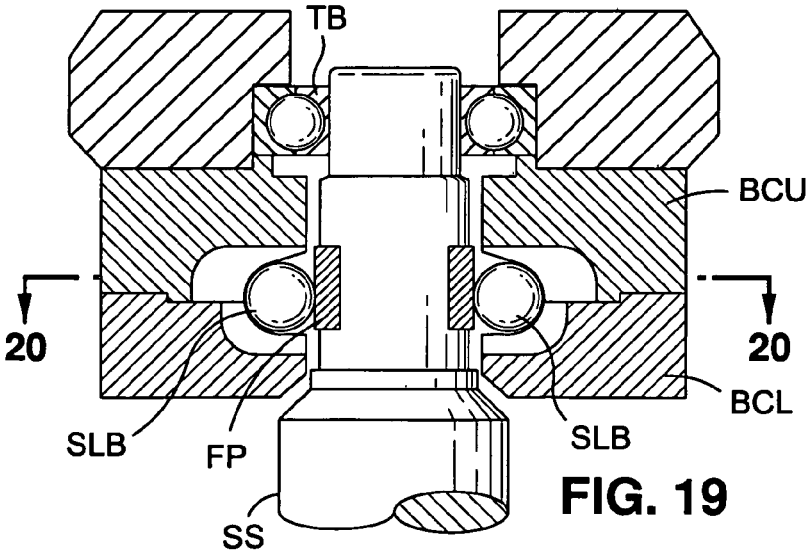
FIG. 19 is a partial, cross-sectional view of the ball, self-locking device of FIG. 18 illustrating the balls in a shaft locking position during the non-operative intervals of the pumping apparatus.

A modified version of the self-locking arrangement of FIGS. 15-17 is illustrated in FIGS. 18-20. In this embodiment the shaft SS is modified by the addition of a friction pad FP secured to the circumference of the shaft SS for braking or self-locking the shaft by the balls SLB. The friction pad FP may be constructed of "TEFLON" or a ceramic friction pad. The tracks for the balls in the embodiment of FIGS. 18-20 are defined by two carriers BCU and BCL. Each carrier has a track of a slightly different configuration and arranged in complimentary fashion for controlling the balls SLB therein including their braking or self-locking positions with the friction pad FP as illustrated in FIGS. 19 and 20. It should be noted that the depth of the tracks in the two carriers BCU and BCL are different so when mated as in FIG. 19 they act to trap a locking ball SLB within the resulting arcuate configuration of the two carriers and in engagement with the friction pad FP for preventing the shaft SS from rotating. The four balls SLB are each trapped against the friction pad FP for locking up the shaft SS as is evident by viewing FIG. 20 when the fluid pumping apparatus is non-operative. Similarly when the pumping is operative, the friction and centrifugal forces cause the balls SLB to move outwardly of the friction pad FP for permitting the shaft SS to normally operate without any braking or self-locking forces.

Figure 21:
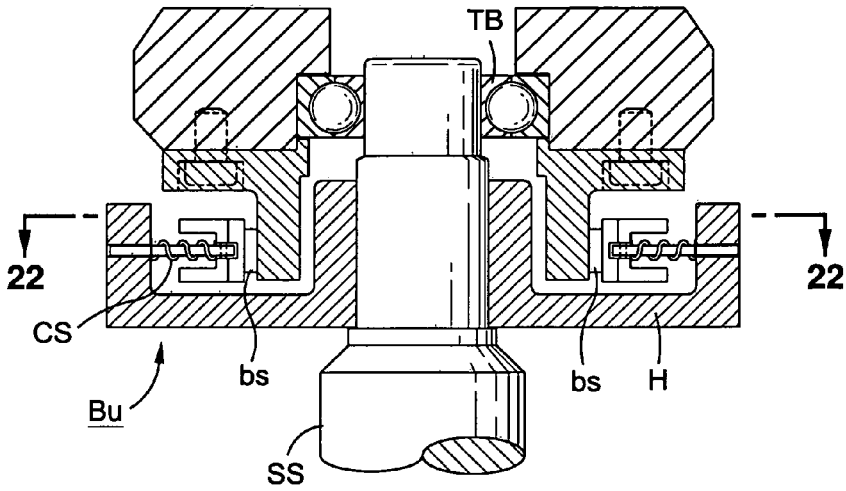
FIG. 21 is a partial, cross-sectional view of the pump shaft illustrating an automatic centrifugal brake device mounted to the pump shaft for preventing the pump shaft from rotating during the non-pumping intervals and maintaining the pump bearings out of deflection and illustrating the centrifugal brake device operative for preventing the rotation of the pump shaft.
Figure 22:
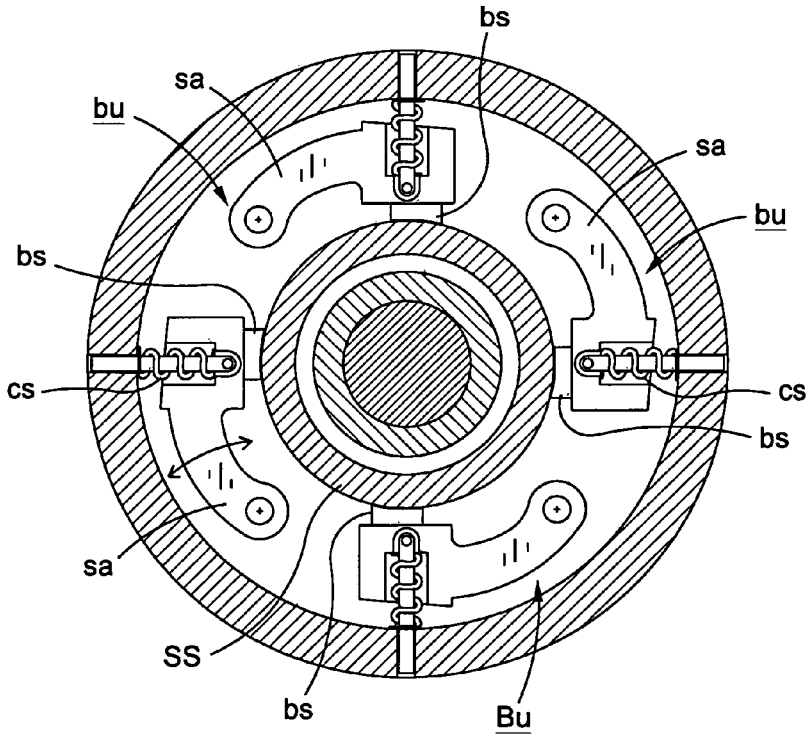
FIG. 22 is a cross-sectional view taken along the line 22-22 of FIG. 21.

Referring to FIGS. 21 and 22, the concept for the automatic centrifugal brake will be described. In this arrangement a brake shoe bs is attached to the shaft SS just below the tail bearing tb; see FIG. 21. The brake shoe bs is attached to a coiled spring cs and the brake shoe arranged in engagement with the stationary part of the apparatus or the hub H secured to the shaft SS, as illustrated in the drawings. The brake is attached to the brake shoe bs and the coiled spring cs. The arrangement is such that as the shaft SS rotates the spring cs compresses in response to the centrifugal forces generated by the rotating shaft causing the brake shoe to move away from the stationary part of the apparatus. The spring cs and brake shoe bs are mounted on a swingable arm sa pivoted at one end for allowing the brake shoe bs to move radially outwardly away from the shaft and thereby disengaging the brake shoe bs from the shaft ss. As illustrated in the drawings the arrangement is that four brake shoes are mounted to swingable arms sa in approximately 90 degrees apart around the shaft SS to provide the desired action.

Figure 23:
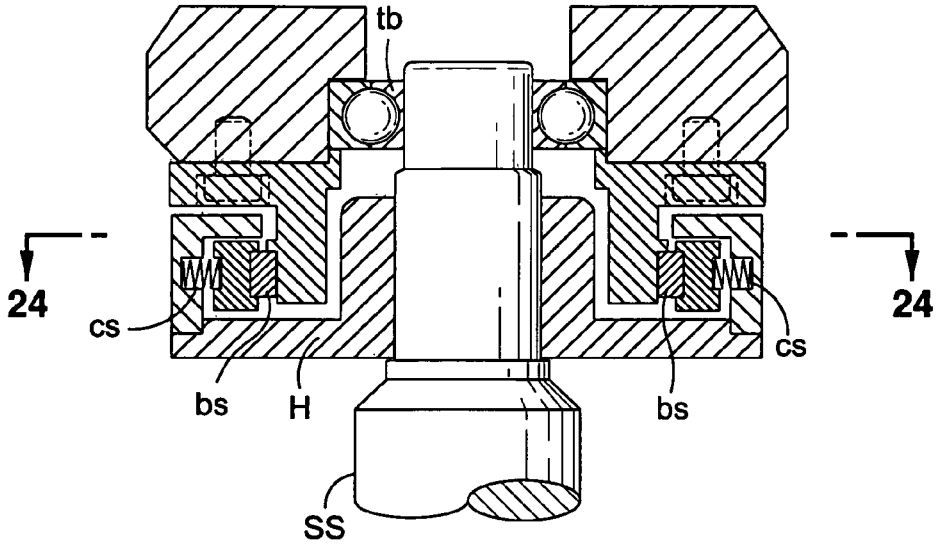
FIG. 23 is a partial, cross-sectional view of the pump shaft having an improved, automatic, centrifugal brake device of more compact structure and easier to assemble than the embodiment of FIG. 21.
Figure 24:
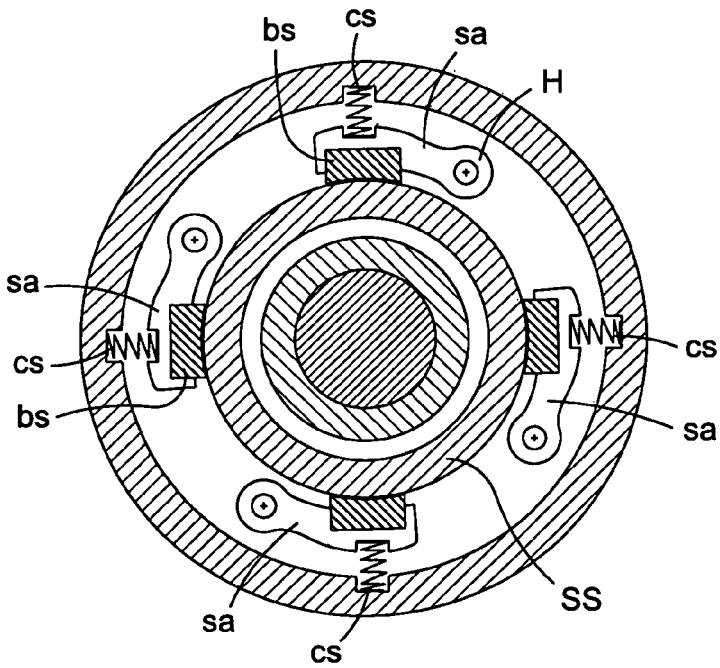
FIG. 24 is a cross-sectional view taken along the line 24-24 of FIG. 23.

A further modification of the concept represented by FIGS. 21 and 22 is illustrated in FIGS. 23 and 24. The structure has a more compact assembly allowing for ease in assembly but functions basically the same as in the FIGS. 21 and 22. The corresponding parts in the two embodiments bear the same reference character.

Figure 25:
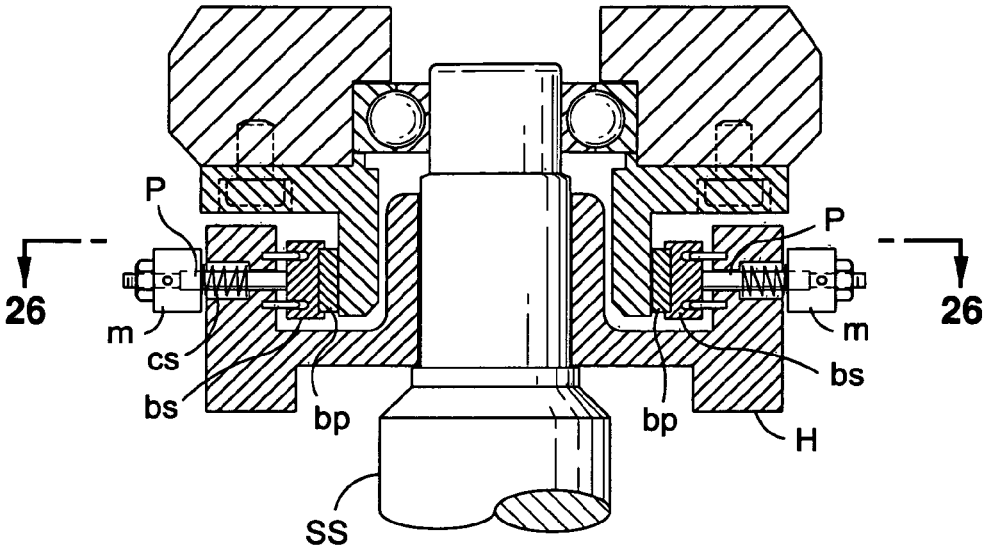
FIG. 25 is a partial, cross-sectional view of the pump shaft illustrating a piston type, automatic centrifugal brake device for preventing the pump shaft from rotating during the non-pumping intervals.
Figure 26:
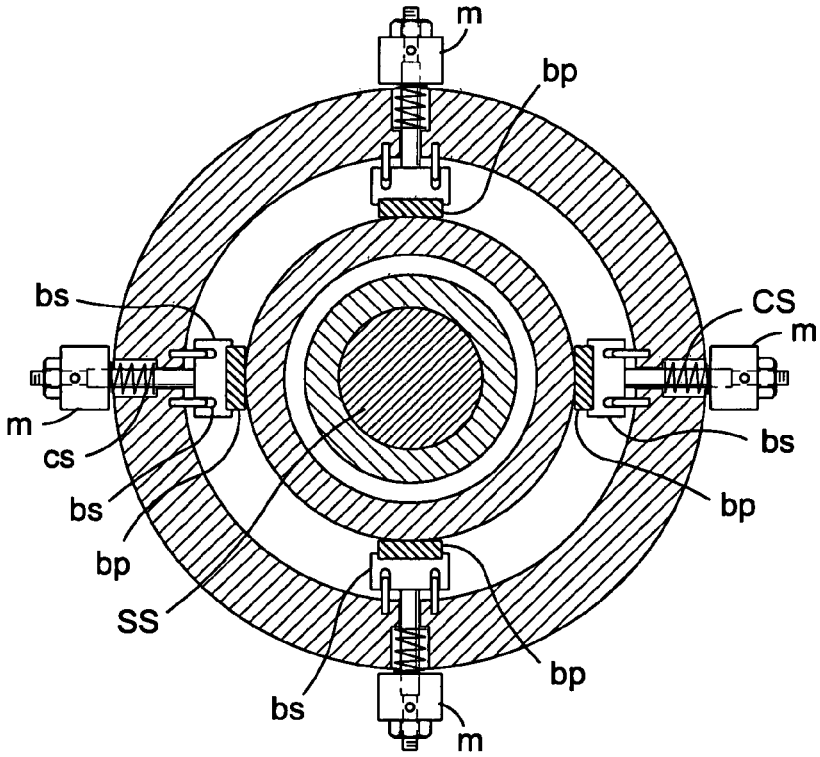
FIG. 26 is a cross-sectional view taken along the line 26-26 of FIG. 25.

FIGS. 25 and 26 discloses a piston automatic centrifugal brake device for preventing the pump shaft from rotating during the non pumping intervals. The piston P is mounted in an aperture PA of the hub H for axial movement. The piston P has a pre-selected mass or weight M on the end of the piston P extending beyond the end of the hub as illustrated. The opposite end of the piston P, the right hand end for the left side of the shaft SS as viewed in FIG. 25 mounts a brake shoe bs and a break pad by illustrated in engagement with one another for braking the shaft. This is the rest position of the brake when the shaft SS is not rotating. During rotation of the shaft SS the centrifugal forces that are generated cause the mass m to move radially outwardly with the piston P so as to cause the disengagement of the brake shoe bs and brake pad by thereby allowing rotation of the shaft SS. When the shaft SS stops rotating, the mass is calibrated to return to its at rest position, collapsing the spring CS and causing the brake shoe bs to, once again engage the brake pad bp. As is evident from FIG. 26, there are four identical brakes mounted around the shaft SS at approximately 90 degrees apart to provide the necessary shaft braking action.

Figure 27:
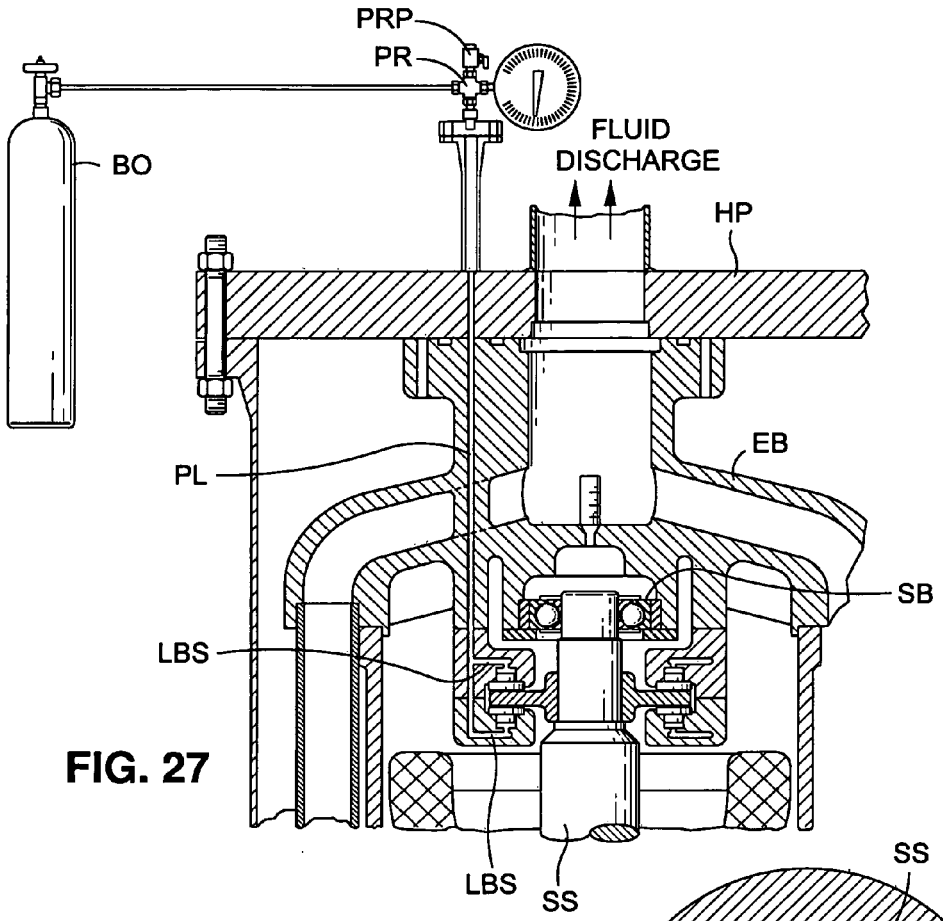
FIG. 27 is a partial, cross-sectional view of the pump shaft with a disc brake secured to the shaft contacting with brake shoes on opposite sides of the shaft to respond to fluid pressure applied thereto for applying the brake shoes to the disc brake and with pressure regulator and pressure storage bottle arranged outside the pressure vessel in communication with the brake shoe for preventing the pump shaft rotation and supports the shaft to remove stress on the shaft bearings.
Figure 28:
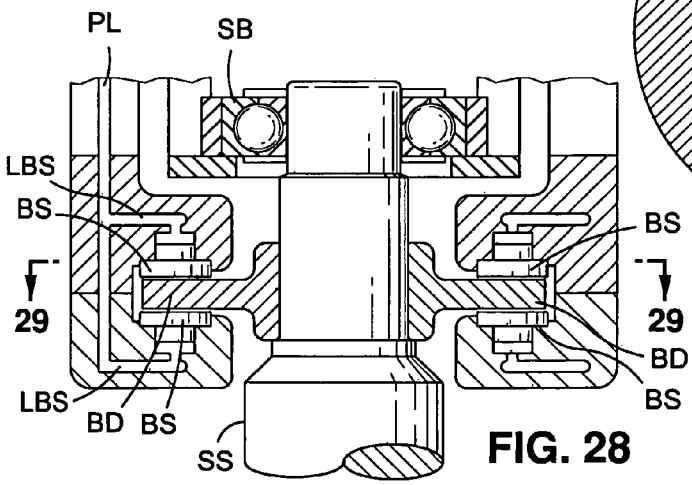
FIG. 28 is an enlarged view of the disc brake and brake shoes of FIG. 27 as mounted on the pump shaft when responsive to fluid pressure for supporting the shaft and preventing rotation applicable to a marine vessel subject to direct dynamic motions imparted to the marine vessel.
Figure 29:
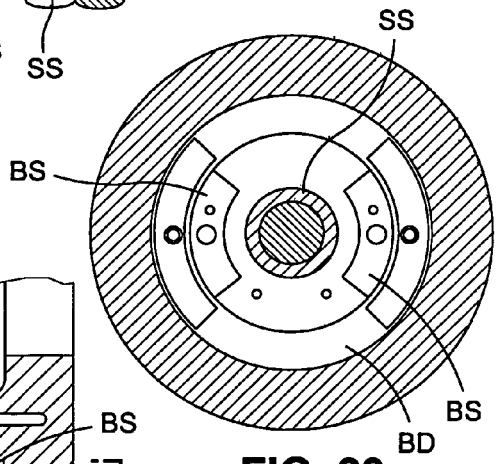
FIG. 29 is a cross-sectional view taken along the line 29-29 of FIG. 28.

Now referring to FIGS. 27-29 a rotary shaft holding device having a disc brake will be examined from the standpoint of providing a support for the pumping shaft during non-operation intervals of the pumping apparatus to relieve the bearings of the weight and to keep the shaft from spinning during the idle pumping intervals and thereby extend the life and reliability of the high pressure pumping apparatus. The device is not used with any other support device and is directly applicable for the multi-stage high pressure pumps mountable on the upper decks of the LNG marine vessels MV as illustrated in FIG. 1 and the multiplicity of motions the marine vessel is subject to.

FIG. 27 illustrated the top section of the suction vessel SV corresponding to the view in FIG. 3 and includes the head plate HP, pump end bell EB and below the upper most bearing SB for the single shaft SS as illustrated in FIG. 3. The shaft SS in this embodiment is provided with a brake disc BD extending on opposite sides of the shaft; see FIG. 28. The brake discs BD rotate in unison with the shaft SS. Each disc BD contacts with a brake shoe BS acting on an individual surface of a brake disc BD. The brake shoes BS engage the brake discs for braking purposes only when fluid under pressure is applied to the brake shoes BS. For this purpose, there is provided outside the vessel SV a pressure regulator PR mounted at the pressure relief port PRP for the vessel SV. The fluid under pressure is stored in a bottle BO and is coupled to the pressure regulator PR and the read out dial for the pressure regulator. The fluid under pressure is coupled through the pressure lines PL running between the pressure regulator PR through the head plate HP and to the brake shoes BS. The pressure line PL is connected to pressure line LBS for direct application to the brake shoe for shaft braking purposes. A pressure line LBS couples the fluid under pressure directly to the individual brake shoes on the opposite sides of the brake discs BD; see FIG. 28. The construction is such that when the pumping apparatus is not operating the brake shoes BS are each engaging the brake discs BD. In this manner the shaft SS is supported and eliminates any stress to the bearings. When the fluid under pressure is coupled to the brake shoes to provide the necessary braking action that prevents the shaft SS from rotating when the pumping apparatus is idle.

Figure 30:
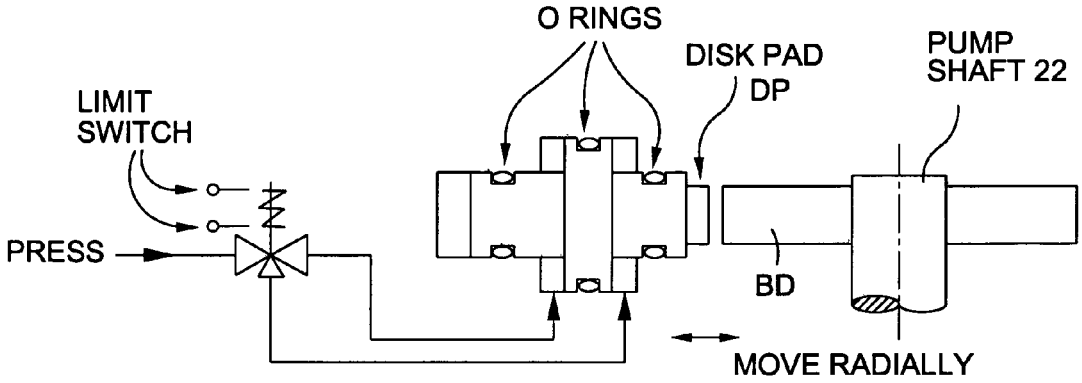
FIG. 30 is a diagrammatic view of the disc brake embodiment of FIGS. 27-29 but modified to hold the disc brake radially rather than axially to cause the disc pad to move radially into and out of engagement with the brake disc in response to the manual operation of the control apparatus.

It should be noted that the above structure is arranged to hold the brake disc axially but radial holding of the brake disc is also within the scope of this embodiment and is illustrated in FIG. 30. The two structures for manual actuation as a means of better understanding of the desired operation thereof.

The brake disc BD of FIG. 30 is braked by the radial movement of the disc pad DP radially for braking the brake disc BD causing the disc pad DP to engage the brake disc BD and thereby the prevention of rotation of the pump shaft SS when the pumping apparatus is idle. The pressurized system is operative to cause the disc pad DP to move radially away from the brake disc allowing operating of the pump and rotation of the shaft SS.

Now referring to FIG. 30, the sketch merely illustrates only the piston and disc parts to teach the radial action. FIG. 30 illustrates schematically the 3-way valve having a pressure sensitive, manually operated switch provided with a limit switch. The elements having an O ring seal are actuated by a hydraulic actuator (not shown) for actuating one of the O ring sealed elements or a second element arranged approximately 180 degrees apart so the shaft SS will not be stressed by their actuation. The operation is such that by operating the lever associated with the 3-way valve, one side such as the left side shown of the piston disc BD is pressurized and the other side is de-pressurized so as to cause the piston to move radially toward the brake disc BD and contacts the disc BD and thereby locks up the shaft SS preventing rotation. The reverse action results upon de-pressurization of the disclosed apparatus.

The same structures may be actuated by an automatic control system which may include the use of a 3-way control valve and limit switch for the valve. An automatic control unit for this purpose is diagrammatically illustrated in FIG. 31.

Figure 31:
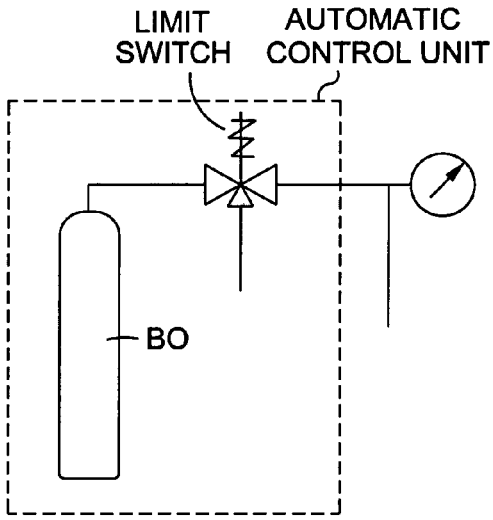
FIG. 31 is a diagrammatical view of an automatic control unit for the automatic control of the embodiment of FIG. 30.

The 3-way valve of FIG. 31 is actuated either electrically or pneumatically when the system is pressurized. The system interlock prevents the pump from running by detecting the signal from the limit switch. When the system is depressurized, the permissive signal is active to allow the pump to start by detecting the signal from the limit switch.

It should also be appreciated that the automatic control unit of FIG. 31 may be used with a piston in lieu of the threaded member and nut PN for the manual actuation of the shaft position as illustrated in FIGS. 10 and 11.

The invention claimed is:

1. A high pressure pumping means for use as a tanker ship or on the tanker ship deck and subject to several degrees of ship movements comprising a U-like housing having a head plate for closing the open end of said U-like housing, a single shaft assembly mounted within said U-like housing and vertically extending between the ends of said housing, said shaft assembly having two ends and mounting a multi-stage high pressure pumping means and electrical driving motor means thereon, said shaft assembly being supported by bearing means adjacent said ends of said shaft assembly and third bearing means between the ends of said pumping means and said drive motor, said U-like housing including a plurality of guide rails mounted inside said housing to permit the pumping means to be removed from said housing by slidably moving on said guide rails and permitting said pumping means to be reinstalled within said housing by slidably moving along said guide rails to assure said pumping means is always located within said housing in the same position, protective means for said U-like housing for securing said housing to the tanker ship deck, said protective means being constructed and defined for absorbing vibrations and stresses due to the ship movements, and means for securing the bottom end of said pumping means to said U-like housing for relieving the stress at said head plate for said housing due to the movements of said tanker ship, and for preventing the pumping means from movements within said U-like housing.

2. A high pressure pump as defined in claim 1 wherein said means for securing the bottom end of said pumping means comprises first bracket means connected to said pumping means and extending outwardly to said guide rails adjacent the bottom end of said guide rails, second bracket means mounted to said U-like housing adjacent the bottom end of said guide means and arranged for engaging said first bracket means adjacent the ends of said guide rails to thereby secure said pumping means to said U-like housing at all times to protect against swinging of the pumping means.

3. A high pressure pump as defined in claim 1 wherein said guide rails are constructed of a metal and said second bracket means comprises a metallic bracket constructed of a different metal than the guide rails and having a soft, resilient pad mounted between the connected ends of said first and second bracket means with a pre-selected clearance between said second bracket means and said resilient pad for compensating for the differences in expansion of said metallic bracket and said guide rails while maintaining the first and second bracket means engaged during the operation of said pumping means and the non-operation thereof.

4. A high pressure pump as defined in claim 3 including means for maintaining the bearings out of deflection and single shaft from rotating due to a rocking action of the tanker shifting when said pumping means is not operational.

5. A high pressure pump as defined in claim 3 including means for supporting said single shaft assembly from the bottom of said shaft to maintain said bearings from deflecting and said shaft means from rotating due to the rocking motion of tanker shifting when said pumping means is not in operation.

6. A high pressure pump as defined in claim 5 wherein said means for supporting said shaft assembly comprises manual means for rotating the bottom end of said shaft assembly for adjusting the position up or down, of the shaft assembly to a pre-selected position without overstressing said bearing means.

7. A high pressure pump as defined in claim 6 including chevron sealing means secured to said shaft assembly adjacent the bottom end of said shaft spaced a pre-selected distance from said manual means and provides access to said means for supporting said shaft assembly.

8. A high pressure pump as defined in claim 6 wherein said means for supporting said shaft assembly comprises externally fluid pressure actuating means for controlling said means for supporting said shaft assembly and normally disengaged from said shaft to permit rotary action of said shaft and when engaged with said means for supporting said shaft raises said supporting means to engage said shaft and maintains said shaft out of rotation.

9. A high pressure pump as defined in claim 8 including pin means for said shaft supporting means for further anti-rotation protection of said shaft when said shaft support means is actuated.

10. A turbo machine for use in a tanker ship or the tanker ship deck and subject to several degrees of ship movements comprising a U-like suction housing having a head plate for closing the open end of said U-like housing, a single shaft assembly mounted within said U-like housing and vertically extending between the ends of said housing, said shaft assembly having two ends and mounting a turbo machine and electrical driving motor means thereon, said shaft assembly being supported by individual bearing means adjacent said ends of said shaft assembly and third bearing means between the ends of said turbo machine and said drive motor means, said U-like housing including a plurality of guide rails mounted inside said housing to permit the turbo machine to be removed from said housing by slidably moving on said guide rails and permitting said turbo machine to be reinstalled within said housing by slidably moving along said guide rails to assure said turbo machine is always located within said housing in the same position, protective means for said U-like housing for securing said housing to the tanker ship deck at all times, said protective means being constructed and defined for absorbing vibrations and stresses due to the ship movements, and an individual housing for said turbo machine extending between an end bearing means and said third bearing means within said U-like housing, and means for securing the bottom end of said turbo machine housing to said U-like housing for relieving the stress at said head plate for said housing due to the movements of said tanker ship.

11. A turbo machine as defined in claim 10 wherein said means for securing the bottom end of said turbo machine housing comprises first bracket means connected to said turbo machine housing and extending outwardly to said guide rails adjacent the bottom end of said guide rails, second bracket means mounted adjacent the bottom end of said guide rails means and connected to said U-like housing and arranged for engaging said first bracket means adjacent the ends of said guide rails to thereby secure said turbo machine housing to said U-like housing at all times to protect against swinging of pump within said u-like housing.

12. A turbo machine as defined in claim 11 wherein said turbo machine comprises a high pressure pumping means.

13. A turbo machine as defined in claim 11 including further means for preventing shaft rotation.

14. A method of adapting a normally land based high pressure pumping apparatus for marine vessel use while subjected to a multiplicity of several degrees of marine motions, vibrations and rocking without causing damage to the pumping apparatus or shortening the useful life of said pumping apparatus, said pumping apparatus comprising pumping means and motor drive means mounted on a single shaft assembly supported by bearing means, comprising the steps of axially elevating and supporting said single shaft assembly to keep said bearing means out of deflection due to major shifts of the marine vessel resulting from the rocking of the marine vessel, providing radial damping of vibrations from wearing the bearing means due to the rocking of the marine vessel, and maintaining said shaft assembly from rotating during the non-operation of said pumping means.

15. A method of supporting high pressure fluid pumping apparatus to prevent damage to bearings supporting the pumping apparatus due to various marine vessel's movements including rocking motions including the steps of mounting high pressure fluid pumping means on a single shaft within a housing and vertically oriented within the housing, supporting the single shaft on bearing means adjacent the ends of the housing for the pumping means, arranging the housing for the pumping means in a suction vessel to be vertically oriented on a marine vessel and subject to the vessel's movements, supporting and elevating the single shaft axially from the bottom of said shaft for preventing said bearing means from deflecting downwardly only when said pumping means is not operating and preventing the rotation of said shaft due to the marine vessel's movements and shifting due to rocking, securing the suction vessel to the marine vessel's deck for absorbing vibrations and stresses due to the vessel's movements, and securing the bottom of the housing for the pumping means to the suction vessel for relieving the stresses on the suction vessel and preventing the housing for the pumping means to sway within the suction vessel.

16. A method as defined in claim 15 wherein the step of supporting and elevating the single shaft comprises automatically supporting said shaft in response to high pressure actuation for moving the shaft upwardly with the cessation of the operation of the pumping means to prevent said bearing means from deflecting downwardly.

17. A method as defined in claim 15 or 16 including permitting access to said shaft and including means for manually rotating the end of said shaft for changing the position thereof.

18. A method as defined in claim 17 wherein said means for manually rotating said shaft includes stopper means to prevent over stressing of said bearing means due to the manual rotation of said shaft.

19. A turbo machine for use on a marine vessel subject to several degrees of ship movement comprising a shaft assembly, turbo machine means carried on said shaft assembly, housing means for enclosing said turbo machine means and with the shaft assembly extending outwardly of said housing means mounted adjacent the ends of said turbo machine and arranged for supporting said shaft adjacent one of said bearing means, a thrust equalizing device being arranged on said shaft to cause the shaft to be axially and bi-directionally, movable in response to the thrust forces generated by the turbo machine means for equalizing said thrust forces, said shaft carrying a catch disc mounted to the circumference of said shaft and constructed and defined to keep the bearing means from deflecting when said turbo machine is inoperative and to keep the shaft from rotating when said turbo machine is inoperative, said catch disc is constructed to function with seating means mounted with said turbo machine means for engaging and disengaging said seating means, the arrangement of the catch disc and said seating means being normally in engagement when the turbo machine means is inoperative for supporting said turbo machine means by said catch disc means whereby the weight of said turbo machine prevents an upward axial travel of said shaft assembly whereby the bearing means carry no load and the catch disc prevents a downward axial travel of said shaft assembly, said shaft is axially movable in upward direction in response to the pressure differentials generated with said turbo machine when in operation to thereby disengage said catch disc from seating means allowing normal operation of said turbo machine means.

20. A turbo machine as defined in claim 19, including further means for assuring that said shaft does not rotate during the time intervals said turbo machine means is not operative.

21. A high pressure pump mountable on a tanker ship deck subject to several degrees of ship movement and stabilizing the pump against the ship movements to prevent damage to the pump's bearings and pump shaft comprising high pressure pumping means designed and constructed for operation on a stable platform, the pump designed and constructed as a "sendout" pump on a tanker ship deck for liquefied natural gas, said high pressure pumping means comprising a single shaft assembly having two ends for mounting high pressure pumping means and an electrical drive motor thereon, said shaft assembly being bi-directionally, axially movable, first bearing means mounted on said shaft for said electrical drive motor adjacent one end of said shaft, said pumping means mounted on said shaft on the opposite side of said bearing means and said drive motor from adjacent the other end of said shaft, second bearing means mounted to said shaft adjacent the opposite end of said shaft from said one end, said pumping means having a fluid inlet and fluid discharge outlet including thrust equalizing means mounted to said shaft adjacent said second bearing means, said shaft mounting impeller means for said pumping means being rotatable with said shaft in response to a fluid to be pumped coupled through said pumping means for changing a high velocity, low pressure fluid stream leaving the impeller means into a low velocity, high pressure stream at said discharge outlet for said pumping means when said single shaft has said drive motor energized and stabilizing means securable to ship deck to axially support said shaft assembly for keeping said bearing means from responding to any ship movements or rocking actions by deflecting and any major shifts due to rocking action on said shaft while keeping the shaft assembly from rotation when said drive motor is non-operational.

22. A high pressure pump as defined in claim 21 wherein said stabilizing means comprises catch disc means constructed and defined on said shaft assembly adjacent said second bearing means, seating means for said catch disc means for preventing the rotation of said shaft assembly when said drive motor is not operative and said catch disc means and said seating means are in seating contact due to weight of said pumping means thereby preventing the upward axial travel whereby said catch disc means functions to support said pumping means during the pumping intervals and when said drive motor is operative said shaft assembly axially moves to disengage said catch disc means and seating means allowing normal pumping action to occur until said drive motor is rendered inoperative and said shaft assembly axially moves to cause said catch disc means, and seating means to engage one another thereby maintaining said bearing means out of deflection and said shaft assembly from rotating when said pumping means is non-operative.

23. A method of preventing a rotatable shaft for a high pressure multi-stage pumping means from spinning and damage during the periods of non-operation of the pumping means, providing the rotatable shaft with a plurality of guide tracks spaced around the shaft for permitting at least a single ball to move within each guide track from a position spaced from the rotatable shaft during operative periods of said pumping means to an end of the guide track for self locking the shaft by said ball to prevent the shaft from rotating during the time intervals said pumping means is idle.

24. In combination, high pressure, multi-stage fluid pumping means mounted on a single shaft, guide track means mounted to the single shaft to be rotatable with said shaft, said guide track means having a plurality of individual tracks for receiving locking balls to move along the tracks from one end spaced from the shaft to the opposite end of the guide track in a self-braking position with the shaft for preventing he shaft from rotating when the pumping means is idle, the locking balls being responsive to the operation of said fluid pumping means to move along the guide tracks away from said self-braking position permitting said pumping means to operate normally.

25. In combination as defined in claim 24 including shaft braking means mounted adjacent one end of each guide track means for engaging a locking ball at said shaft braking means to prevent rotation of the shaft.

26. A high pressure pump mountable on a tanker ship deck subject to several degrees of ship movement and stabilized against the ship movements to prevent damage to the pump's bearings and the pump shaft comprising high pressure pump means designed and constructed for operation on a stable platform, the pump designed and constructed as a "sendout" pump for liquefied natural gas, said high pressure pump comprising a single shaft assembly for mounting high pressure, centrifugal pumping means and an electrical drive motor thereon, said shaft assembly being bi-directionally axially movable, first bearing means mounted on said shaft for said electrical drive motor adjacent one end of said shaft, said pumping means mounted on said shaft on the opposite side of said drive motor from said first bearing means, second bearing means mounted to said shaft adjacent the opposite end of said shaft from said one end, said pumping means having a fluid inlet and fluid discharge outlet including thrust equalizing means mounted to said shaft adjacent said second bearing means, said shaft mounting impeller means for said pumping means being rotatable with said shaft in response to the energization of said drive motor so that a fluid to be pumped is coupled through said pumping means changes a high velocity, low pressure fluid stream coupled to said impeller means into a low velocity, high pressure stream at said discharge outlet for said pumping means when said single shaft is not energized by said drive motor, a common housing means for said pumping means and said drive motor for enclosing and isolating said shaft assembly between said one end of said shaft and the opposite end of said shaft, said first bearing means having an inner race mounted to said shaft and an outer race loosely mounted against said common housing to permit the shaft to move axially, bi-directionally, relative to said common housing a preselected distance, containment vessel means mounted over and in spaced relationship with said common housing, said vessel having a fluid flow inlet for conveying a fluid to be pumped into said centrifugal pumping means, and stabilizing means securable to ship deck to axially support said shaft assembly for keeping said bearing means from responding to any ship movements or rocking by deflecting and any major shifts due to rocking action on said shaft while keeping the shaft assembly from rotation when said drive motor is non-operational.

27. A method of supporting turbo machine means for utilization on a marine vessel subject to several degrees of ship movements from damage due to said ship movements, said method comprising mounting turbo machine means within a housing on a single shaft and vertically extending between the ends of said housing, mounting said housing in a vertical position on the marine vessel and vertically supporting the turbo machine means by bearing means, carried by said single shaft, maintaining the bearing out of deflection when the turbo machine is not operative by elevating and supporting said single shaft from the bottom of the shaft to prevent damage due to rocking action of the marine vessel when turbo machine is not operative, securing said housing to the marine vessel for absorbing vibrations and stresses due to the vessel's movements and thereby preventing bearing damage, and securing the bottom end of said turbo machine means to said housing for relieving the stresses to said housing to thereby secure the turbo machine means from swinging within said housing.

28. A method of mounting high pressure pumping apparatus housing within a suction vessel for use of the pumping apparatus on a marine vessel subject to various degrees of movement while the vessel is in transit including the steps of providing a suction vessel having a plurality of guide rails mounted on the inside of said vessel to allow for said pumping apparatus to be moved into and out of said suction vessel by means of said guide rails, attaching first bracket means to the outside of the housing for the pumping apparatus at the end of the housing to extend outwardly to the guide rails, attaching second bracket means to the inside of said suction vessel adjacent the end of each guide rail for engagement with the said first bracket means for securing said housing for the pumping apparatus to said suction vessel at all times during the movements of the marine vessel.

29. A method as defined in claim 28 including attaching bracket means to the housing for the pumping apparatus to the opposite side of said housing from said first bracket for securing the housing to the marine vessel's deck at all times for absorbing the vibrations and stresses of the marine vessel's movements.

30. A high pressure, multi-stage fluid pumping means adapted to be useful on a marine vessel subject to various motions without damaging said pumping means, said multi-stage fluid pumping means being mounted on a single, rotatable shaft, a braking disc mounted on said rotatable shaft to be rotatable with the shaft, said braking disc having a braking surface on opposite sides of said shaft, spaced bearing means for said rotatable shaft and normally supporting the shaft, brake shoe means engageable with a braking surface of the braking disc, a source of fluid pressure for coupling to said brake shoe means for actuating said brake shoes and moving said shoe means in braking engagement with the braking surface of said braking disc for supporting said single shaft and thereby remove the weight off of said spaced bearing means during the intervals of said fluid pumping means is idle, the actuated brake means is further effective to keep the single shaft from rotating.

31. A high pressure, multi-stage fluid pumping means as defined in claim 30 wherein said braking disc comprises braking surfaces on both sides of the braking disc and on both sides of said shaft, a plurality of brake shoes for braking engagement with the braking surfaces of said braking disc whereby each braking surface has at least a single braking shoe engageable therewith.

* * * * *

UNITED STATES PATENT AND TRADEMARK OFFICE

CERTIFICATE OF CORRECTION

PATENT NO. : 8,162,596 B1
APPLICATION NO. : 12/148092
DATED : April 24, 2012
INVENTOR(S) : Keijun Kamio It is certified that error appears in the above-identified patent and that said Letters Patent is hereby corrected as shown below:

column 12, line 9
brakepad should be -- brake pad bp --;

column 12, line 15
brake pad by should be -- brake pad bp --;

column 13, line 44
for use as a tanker should be -- for use in a tanker; -- column 17, line 65
“he shaft” should be -- the shaft --.

Signed and Sealed this
Third Day of July, 2012

David J. Kappos

David J. Kappos
*Director of the United States Patent and Trademark Office*